US011161021B2

(12) United States Patent
Becktor et al.

(10) Patent No.: US 11,161,021 B2
(45) **Date of Patent: *Nov. 2, 2021**

(54) GOLF CLUB WITH GROOVED STRIKING FACE

(71) Applicant: SUMITOMO RUBBER INDUSTRIES, LTD., Kobe (JP)

(72) Inventors: Mika Becktor, Costa Mesa, CA (US); Jacob Lambeth, Irvine, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/271,169

(22) Filed: Feb. 8, 2019

(65) Prior Publication Data

US 2019/0168088 A1 Jun. 6, 2019

Related U.S. Application Data

(62) Division of application No. 15/198,867, filed on Jun. 30, 2016, now Pat. No. 10,238,932.

(51) Int. Cl.
*A63B 53/04* (2015.01)
*A63B 53/00* (2015.01)

(52) U.S. Cl.
CPC ..... *A63B 53/0487* (2013.01); *A63B 53/007* (2013.01); *A63B 53/04* (2013.01); *A63B 53/0408* (2020.08); *A63B 53/0445* (2020.08)

(58) Field of Classification Search
CPC ... A63B 53/0487; A63B 53/04; A63B 53/007; A63B 2053/0408; A63B 2053/0445
USPC ..... 473/324–350, 287–292
See application file for complete search history.

(56) References Cited

U.S. PATENT DOCUMENTS

| | | | | | |
|---|---|---|---|---|---|
| 1,337,958 | A | | 4/1920 | Reach | |
| D63,284 | S | * | 11/1923 | Challis | D21/736 |
| 1,965,954 | A | | 7/1934 | Davis | |
| 4,529,203 | A | | 7/1985 | Ribaudo | |
| 4,964,641 | A | * | 10/1990 | Miesch | A63B 53/0487 473/330 |
| 5,437,088 | A | | 8/1995 | Igarashi | |
| 5,637,044 | A | | 6/1997 | Swash | |
| 5,688,190 | A | * | 11/1997 | Rowland | A63B 53/04 473/330 |
| 5,690,561 | A | * | 11/1997 | Rowland | A63B 53/04 473/330 |
| 6,007,434 | A | * | 12/1999 | Baker | A63B 53/04 473/330 |

(Continued)

OTHER PUBLICATIONS

Jan. 8, 2018 U.S. Office Action Issued in U.S. Appl. No. 15/198,867.

(Continued)

*Primary Examiner* — Sebastiano Passaniti
(74) *Attorney, Agent, or Firm* — Oliff PLC

(57) ABSTRACT

A golf club is disclosed that has a golf club head with a face having peaks or ridges and deep grooves or valleys. The deep grooves or valleys promote improved "feel" and/or reduced "smash factor" which may be particularly desirable when the golf club head comprises a putter face. The deep grooves or valleys may eliminate the need for costly soft metal alloy faces and/or polymeric or other resilient inserts between the face and the body of the golf club head.

20 Claims, 17 Drawing Sheets

(56) References Cited

U.S. PATENT DOCUMENTS

| | | | | |
|---|---|---|---|---|
| 6,089,993 | A * | 7/2000 | Woodward | A63B 53/0487 473/331 |
| 6,183,379 | B1 | 2/2001 | Kim et al. | |
| 6,224,497 | B1 | 5/2001 | Antonious | |
| 6,257,994 | B1 | 7/2001 | Antonious | |
| 7,166,039 | B2 | 1/2007 | Hettinger et al. | |
| 7,278,928 | B2 * | 10/2007 | Newman | A63B 53/047 473/342 |
| 7,540,810 | B2 | 6/2009 | Hettinger et al. | |
| 7,566,276 | B2 | 7/2009 | Billings | |
| D607,070 | S | 12/2009 | Wada et al. | |
| 7,674,188 | B2 | 3/2010 | Ban | |
| 7,677,990 | B2 | 3/2010 | Ban | |
| 7,695,377 | B2 | 4/2010 | Yamagishi et al. | |
| 7,758,449 | B2 | 7/2010 | Gilbert et al. | |
| 7,815,521 | B2 | 10/2010 | Ban et al. | |
| 7,828,671 | B2 | 11/2010 | Ban | |
| 7,846,040 | B2 | 12/2010 | Ban | |
| 7,878,923 | B2 | 2/2011 | Yamagishi et al. | |
| D639,361 | S | 6/2011 | Reinberg | |
| D639,366 | S | 6/2011 | Reinberg | |
| D639,367 | S | 6/2011 | Reinberg | |
| 8,012,036 | B2 | 9/2011 | Nakamura | |
| 8,033,929 | B2 | 10/2011 | Yamagishi et al. | |
| 8,083,605 | B2 | 12/2011 | Franklin et al. | |
| 8,092,320 | B2 | 1/2012 | Yamagishi et al. | |
| 8,109,841 | B2 * | 2/2012 | Miyamichi | A63B 53/0487 473/340 |
| 8,216,081 | B2 | 7/2012 | Snyder et al. | |
| 8,287,401 | B2 | 10/2012 | Tateno et al. | |
| 8,371,958 | B2 * | 2/2013 | Treadwell | A63B 53/04 473/331 |
| 8,523,703 | B2 | 9/2013 | Rife | |
| 8,858,361 | B2 | 10/2014 | Ripp et al. | |
| 8,979,670 | B2 | 3/2015 | Aguayo et al. | |
| 9,452,326 | B2 | 9/2016 | Serrano et al. | |
| 9,539,477 | B2 | 1/2017 | Ripp et al. | |
| 9,566,480 | B2 | 2/2017 | Voges | |
| 9,579,550 | B2 | 2/2017 | Aguayo et al. | |
| D799,619 | S * | 10/2017 | Becktor | D21/759 |
| 9,814,951 | B2 | 11/2017 | Ripp et al. | |
| 9,844,709 | B2 | 12/2017 | Tassistro | |
| 9,943,735 | B2 | 4/2018 | Rife | |
| 10,238,932 | B2 * | 3/2019 | Becktor | A63B 53/007 |
| 10,493,331 | B2 * | 12/2019 | Kroloff | A63B 53/0433 |
| 2008/0051212 | A1 * | 2/2008 | Voges | A63B 53/0466 473/331 |
| 2008/0125241 | A1 * | 5/2008 | Tateno | A63B 53/0487 473/331 |
| 2009/0156328 | A1 * | 6/2009 | Reese | A63B 53/0487 473/331 |
| 2010/0035703 | A1 * | 2/2010 | Ishikawa | A63B 53/0487 473/340 |
| 2010/0311519 | A1 * | 12/2010 | Treadwell | A63B 53/047 473/331 |
| 2013/0331197 | A1 | 12/2013 | Hackenberg | |
| 2015/0057100 | A1 | 2/2015 | Serrano et al. | |
| 2016/0016050 | A1 * | 1/2016 | Rife | A63B 53/0487 473/331 |
| 2016/0375325 | A1 | 12/2016 | Serrano et al. | |
| 2017/0239534 | A1 | 8/2017 | Rife | |

OTHER PUBLICATIONS

Noyce, "Evnroll Putter Has Sweetest Face in Golf", Mar. 9, 2016, http://www.golfalot.com/equipment-news/evnroll-putters-have-sweetest-face-in-golf-3520.aspx.

Jul. 23, 2018 Office Action Issue in U.S. Appl. No. 15/198,867.

* cited by examiner

GOLF CLUB WITH GROOVED STRIKING FACE

RELATED APPLICATIONS AND PATENTS

This application is a divisional of U.S. patent application Ser. No. 15/198,867, filed Jun. 30, 2016. The content of that prior application is incorporated by reference herein in its entirety.

BACKGROUND

This disclosure relates generally to the field of golf clubs. More particularly, it relates to golf clubs having a golf club head with a textured striking face. Even more particularly, it relates to putter-type golf club heads having grooves or valleys and peaks or ridges milled or otherwise formed into the striking face.

Golf club heads come in many different forms and makes, such as metal-woods, irons (including wedges), utility- or hybrid- or specialty-type clubs, and putters. Each of these styles has a prescribed function and general construction. The present disclosure concerns golf clubs and golf club heads, and primarily relates to putter-type golf clubs, which typically are used to strike a golf ball and impart a rolling path on the greens of a golf course.

There are many styles of putters, including but not limited to blades, mallets, heel-toe weighted, and T-line putters. Different types of putters provide different advantages. For example, T-line putters typically have a body member extending rearward from the face. This may help the golfer visualize the intended line of the putt, and may provide improved mechanical attributes. Some putters that are heel-toe weighted are designed for maximum moment of inertia so that when the ball is struck on a location that is offset from the center of the face, the putter resists rotating.

Putters are also governed by the rules of golf set by the USGA. The rules include the heel-toe dimension, the front-to-back dimension, the neck length, the face angle, the lie angle and that the putter shall not be substantially different from the customary and traditional form.

In general, putters comprise a putter head, a striking face, a shaft, and a grip secured at the proximal end of the shaft. The putter head may, but does not always, include a hosel or neck for connecting the distal end of the shaft to the putter head. When used, a hosel or neck may be generally formed from the same material as the putter head, for example, steel. The hosel may be integrally formed with the club head or may be attached thereto via welding or other methods known to those of ordinary skill in the art.

The striking face of putters may take different forms. Some striking faces are smooth, and others are textured, and/or contain graphics. One common technique for providing a textured striking face is to mill the surface of the striking face such that it is roughened, and presents a pattern of grooves, ridges, peaks, valleys and the like. A putter striking face typically has a low loft of, for example, 2°-3°, in order to impart a rolling motion to the golf ball at impact, as opposed to higher lofted golf clubs that launch the ball into the air upon impact.

One important aspect of golf is how the golf club feels during the golf stroke and at the moment of impact with the golf ball. This latter aspect is commonly known as "touch" or "feel." For some golfers, particularly with their putting stroke, a putter that provides good "touch" and/or a soft "feel" at the moment the putter face contacts the ball is highly desirable. There have been attempts to improve putter "touch" and "feel," for example, by placing vibration dampening materials behind or on the club face, as described in U.S. Pat. Nos. 6,334,818 and 6,231,458. Such vibration dampening materials may include, for example, an elastomeric material, such as silicone. Also known is to use as putter faces or putter face inserts soft alloys, such as tellurium copper alloys having a hardness of approximately 80 HB, to improve touch and feel of the club. Another attribute often sought by golfers is a desirable "sound" created when the golf club strikes the ball. This attribute is difficult to quantify, and is often measured by consumer tests that rate whether the consumer finds the sound that results from striking the ball with the club being tested as "good" or "bad." Nonetheless, there remains a need in the art to provide a putter face that imparts improved "touch" and/or softer "feel" and/or "sound" at the moment of impact than is currently achievable.

SUMMARY

One aspect of the disclosure is a putter-type golf club comprising a shaft having a grip at a proximal end of the shaft, and a putter head attached to a distal end of the shaft, the putter head further comprising a heel, a toe opposite the heel, a sole, a top line opposite the sole, and a forwardly-facing striking face, the striking face including a first groove pattern comprising a plurality of arcuate first grooves, each of the arcuate first grooves having, in a preferred hitting zone of the striking face, a depth of 0.010-0.018 inch and a width, as measured along a line perpendicular to a tangent of each of the arcuate first grooves, of 0.004-0.008 inch.

Another aspect of the disclosure is a golf putter having a putter face comprising a plurality of grooves having a depth of 0.010-0.018 inch and exhibiting an average smash factor, upon striking a golf ball, of less than 1.6.

Another aspect of the disclosure is a putter-type golf club head having a top line, a sole, a heel, a toe, and a face, the face having a plurality of peaks and valleys therein, the valleys having a depth of 0.012-0.018 inch.

Another aspect of the disclosure is a putter-type golf club head having a top line, a sole, a heel, a toe, and a face, the face having a plurality of grooves therein, wherein the plurality of grooves comprise: first grooves having a first depth and located in a first region proximate the toe; second grooves having a second depth and located in a second region proximate the heel; and third grooves having a third depth and located in a third region comprising a central hitting zone of the face, wherein the first depth and second depth are different from the third depth.

Another aspect of the disclosure is a golf club head having a top line, a sole, a heel, a toe, and a face, the face having a plurality of grooves therein, wherein the plurality of grooves transition in groove depth from a shallower depth in a first region of the face proximate the toe, to a deeper depth in a second region proximate a hitting zone of the face, to a shallower depth in a third region of the face proximate the heel.

DESCRIPTION OF THE DRAWINGS

The present disclosure is described with reference to the accompanying drawings, in which like reference characters reference like elements, and wherein.

DETAILED DESCRIPTION OF THE DISCLOSURE

Figure 1:
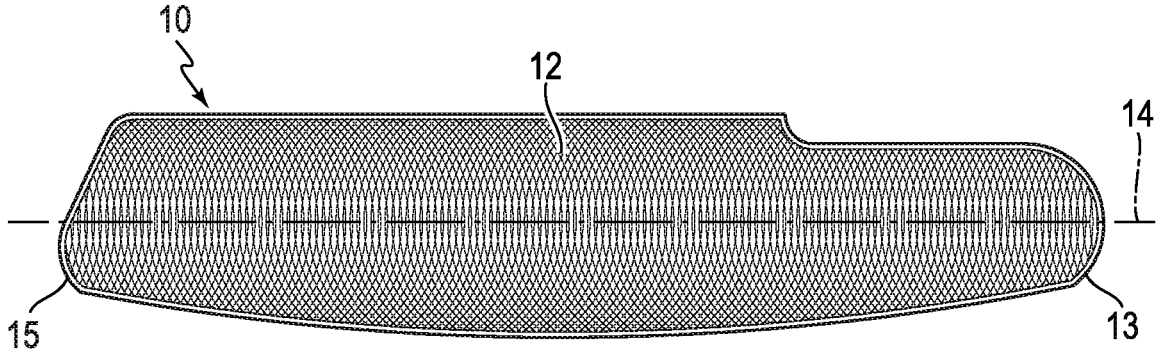
FIG. 1 Prior Art
FIG. 1 illustrates a putter face of the prior art.

Referring to FIG. 1, there is illustrated a schematic representation of a milled putter face, generally 10, of the prior art, in this case, a representation of a Cleveland® Classic Collection putter face. As illustrated, the putter face 10 includes thereon a milled pattern 12, comprising a pattern of ridges, generally light/white, and milled grooves, generally dark/black in the illustration. As further illustrated, the milled grooves are generally of an arcuate shape, and overlap one another, with a first arcuate groove pattern having an orientation with the open portion of the arc facing right, or toward the heel 13 of the putter face 10, and a second arcuate groove pattern having an orientation with the open portion of the arc facing left, or toward the toe 15 of the putter face 10. In this example, both the first and second groove patterns have an identical radius, and the first and second groove patterns are substantially mirror images of each other. These first and second groove patterns may be formed in a single pass with a milling tool that rotates as it travels across the putter face. In the groove pattern of the prior art, the hypothetical center of each arcuate groove may be regarded as lying generally along a centerline 14 of the putter face 10. The arcuate grooves of the prior art putter face 10 of FIG. 1 have a relatively shallow depth of about 0.003 inch.

Figure 2:
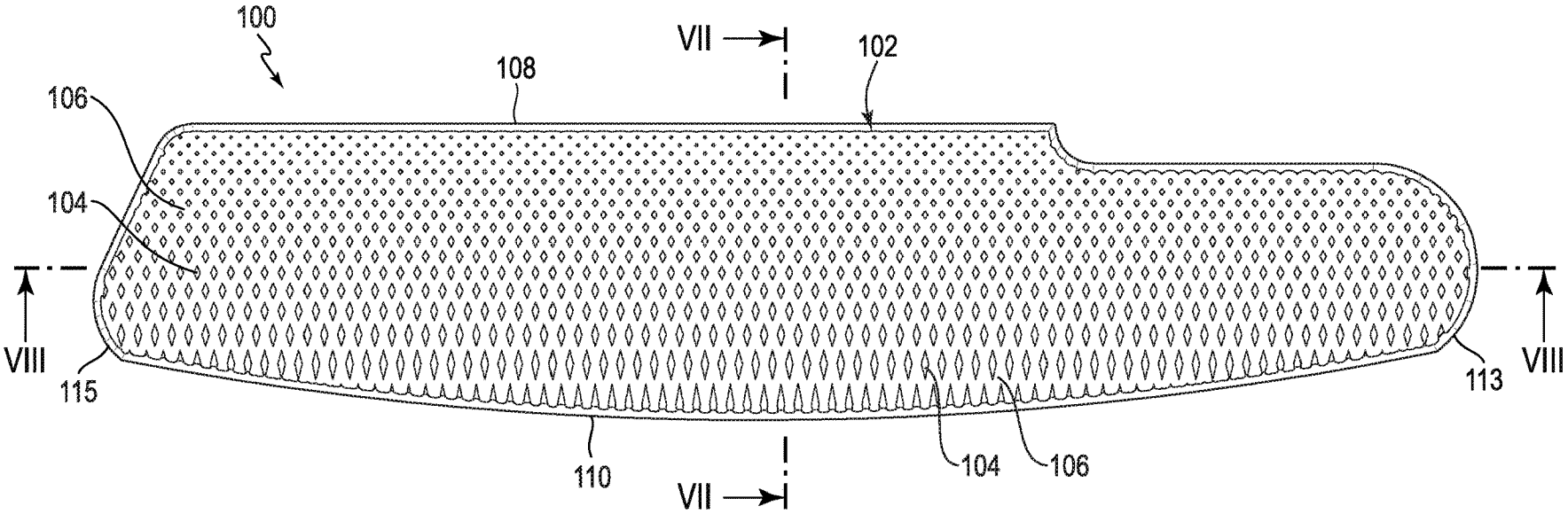
FIG. 2 illustrates a putter face of an embodiment of the present disclosure.

FIG. 2 illustrates a schematic representation of a putter face, generally 100, of the present disclosure. The putter face 100 (and the putter head itself, not shown) comprises a top line 108, a sole 110, a heel 113, and a toe 115. As illustrated, the putter face 100 of FIG. 2 also includes thereon a milled pattern 102, comprising a pattern of ridges 104, generally light/white, and milled grooves 106, generally dark/black in the illustration. These ridges 104 and grooves 106 are more clearly seen in the detail comprising FIGS. 5-8. As illustrated, the ridges 104 and grooves 106 of the disclosure may be generally of greater surface area and wider, respectively, than the ridges and grooves of the prior art putter face 10 of FIG. 1. As further illustrated, the milled grooves 106 of milled pattern 102 may be generally of an arcuate shape, and may overlap one another.

Figure 10:
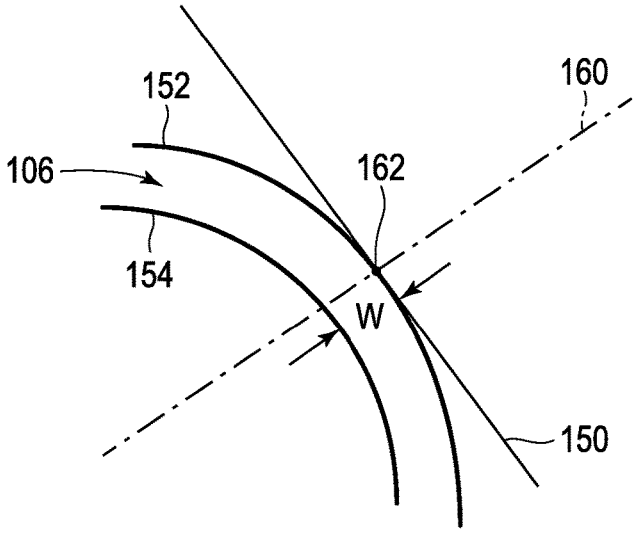
FIG. 10 is a schematic illustration of a groove of a milled pattern of the disclosure, illustrating how the width of the groove may be determined.

The milled pattern 102 of FIG. 2 comprises grooves 106 that may be much deeper than those of the prior art putter face of FIG. 1, having a depth of about 0.010-0.018 inch. The grooves of the embodiment illustrated in FIG. 2 are also preferably wider than those of the prior art, having a width, as measured along a line perpendicular to a tangent of each groove, of about 0.004-0.008 inch. Preferably, each groove may have a depth of about 0.012-0.015 inch, and in a preferred aspect, a width of about 0.06 inch, it being generally understood that width may vary depending on depth due to the profile of the milling insert. FIG. 10 (not to scale) illustrates schematically how the width "W" of an arcuate milled groove, generally 106, may be measured. As illustrated, a tangent line 150 is drawn tangent to one of the side walls, 152, of the arcuate milled groove 106 at tangent point 162. Line 160, drawn perpendicular to the tangent line 150, and through the tangent point 162, defines the width "W" of the groove 106, which is the distance on line 160 between side wall 152 and opposing side wall 154 of the arcuate milled groove 106.

It should be here noted that groove depth and/or groove width may vary across the putter face 100. When the milling tool used to cut the milled pattern 102 is passed across the putter face 100 substantially parallel to the putter face 100, the groove depth will tend to be more uniform across the face. On the other hand, if the milling tool is passed across the putter face 100 along a path that is not substantially parallel to the putter face 100, then variable groove depths across the putter face 100 may result. Unless otherwise stated, reference to preferred groove depth and groove width herein with respect to FIGS. 2-10 is intended to refer to such depths and widths in a preferred hitting zone of the putter face 100, 1200, and 1400.

Figure 15:
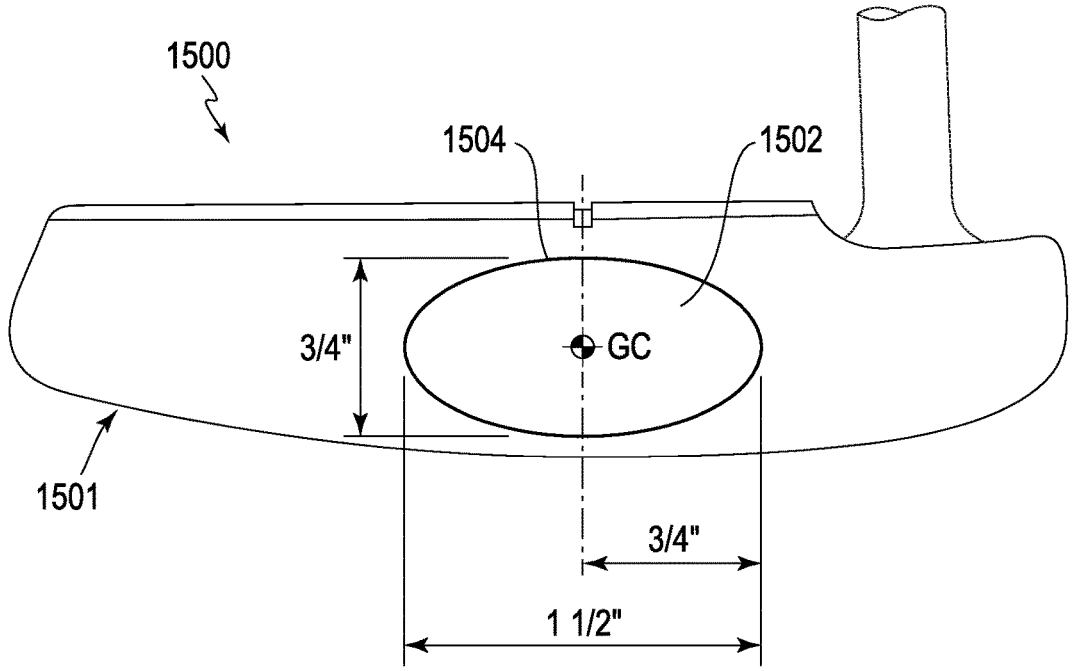
FIG. 15 illustrates a putter head and a geometric center and preferred hitting zone of the disclosure.

FIG. 15 illustrates an example of one such preferred hitting zone, represented in this example on a putter head, generally 1500, having a putter face 1501. In this example, the putter face 1501 has a geometric center GC. In this example, the preferred hitting zone 1502 is represented by an elliptical region defined by an ellipse 1504 that is 1.5 inches long and 0.75 inch high, centered on the geometric center GC. The preferred hitting zone 1502 may be larger or smaller, depending, for example, on type of putter and/or skill of player. It is generally understood that higher handicap golfers are less accurate in ball striking, and thus may have a relatively large hitting zone, such as preferred hitting zone 1502. On the other hand, low handicap or professional golfers tend to be much more accurate with their ball striking, consistently striking the ball at or very near the geometric center GC of the club face 1501, and thus would tend to have a much smaller area preferred hitting zone than that depicted in FIG. 15. While preferred groove depths and groove widths outside of a preferred hitting zone 1502 may be the same or similar to groove depths and widths within the preferred hitting zone 1502, this may not always be the case, as will be described.

Figure 11:
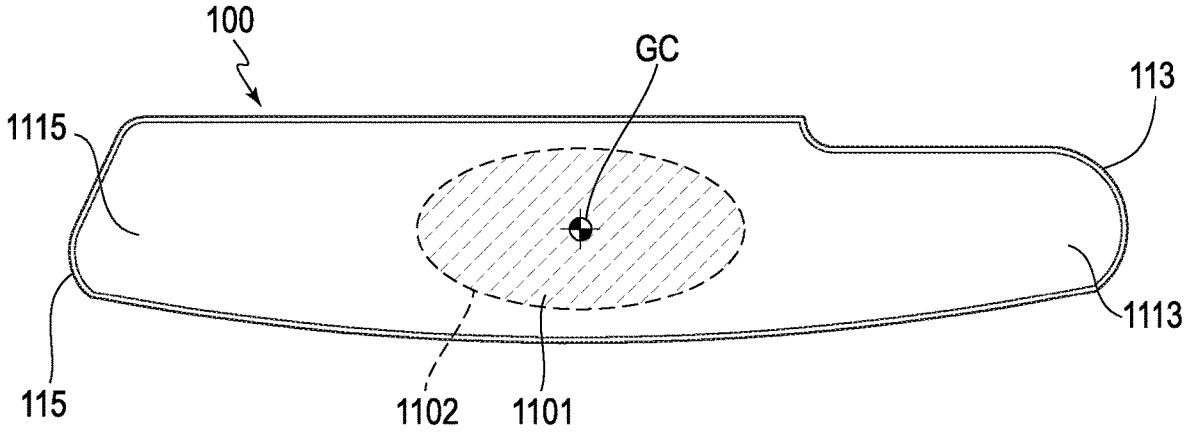
FIG. 11 is a schematic illustration of a putter face of the disclosure, illustrating a preferred hitting zone and geometric center of the putter face.

FIG. 11 illustrates schematically a putter face 100 having a geometric center GC, which is surrounded by a preferred hitting zone, 1101, approximately defined by dotted line oval 1102. The size and shape of this preferred hitting zone (sometimes referred to as the "sweet spot") 1101 may vary from one putter to another, based on variables such as putter head weight, face size and shape, placement of toe and/or heel weights in the putter head, etc. As a general rule, however, it is generally understood that the closer a ball is struck to the geometric center GC of the putter face 100, the more accurate the resulting putt will be, and in general, the farther from the GC the ball is struck, the less accurate the resulting putt will be; lower handicap golfers generally putt within a smaller/tighter oval 1102 than higher handicap golfers.

Referring again to FIG. 2, the milled pattern 102 may comprise a first groove pattern of a plurality of arcuate first grooves that are generally spaced from and not intersecting one another; and a second groove pattern comprising a plurality of arcuate second grooves, wherein the second groove pattern is overlaid onto the first groove pattern, and wherein each groove of the arcuate first grooves comprises a circular arc, and an imaginary circle containing each arcuate groove comprises a center, wherein the center is not positioned on the club face. In this example, both the first and second groove patterns of milled pattern 102 have an identical radius, and the first and second groove patterns are substantially mirror images of each other. Such effect may be achieved by passing a milling tool bit across the putter face 100 as will subsequently be described. The milled pattern 102 of FIG. 2 differs in numerous respects, however, from that of FIG. 1, resulting in significantly improved "touch" and "feel," and "sound," as will be described subsequently.

Figure 3:
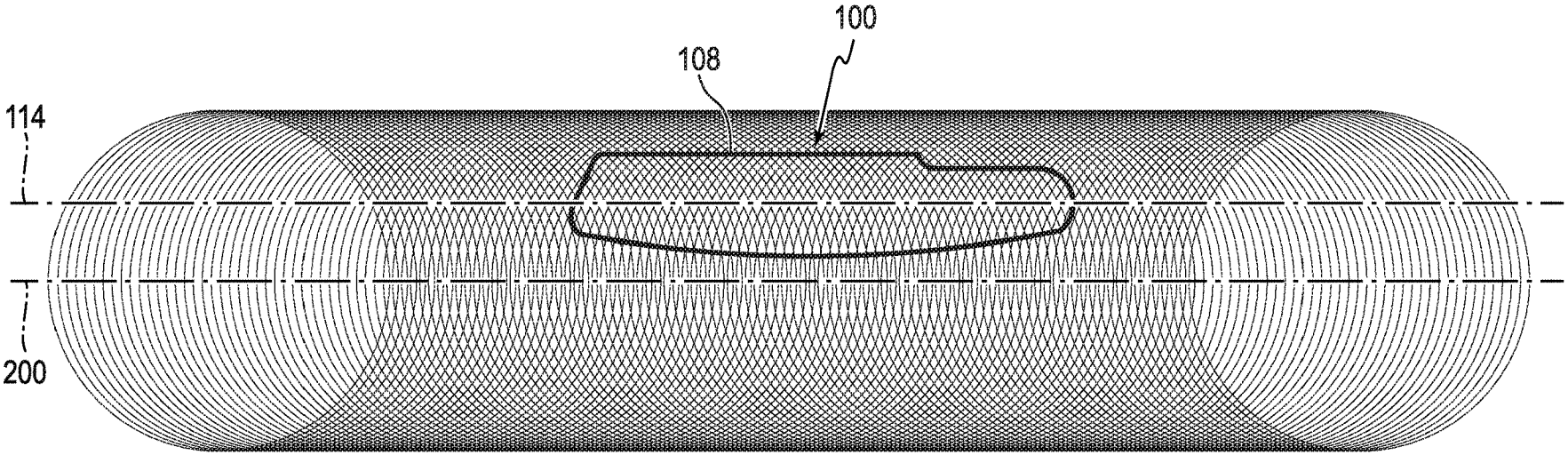
FIG. 3 is a schematic illustration representing how a milling tool, rotating in a circular path, when used according to an aspect of the present disclosure, may be positioned relative to a milled part such as a putter face, and how the tool may travel across the face during the groove milling operation, such that the center of the circular path is below the sole of the putter face.
Figure 4:
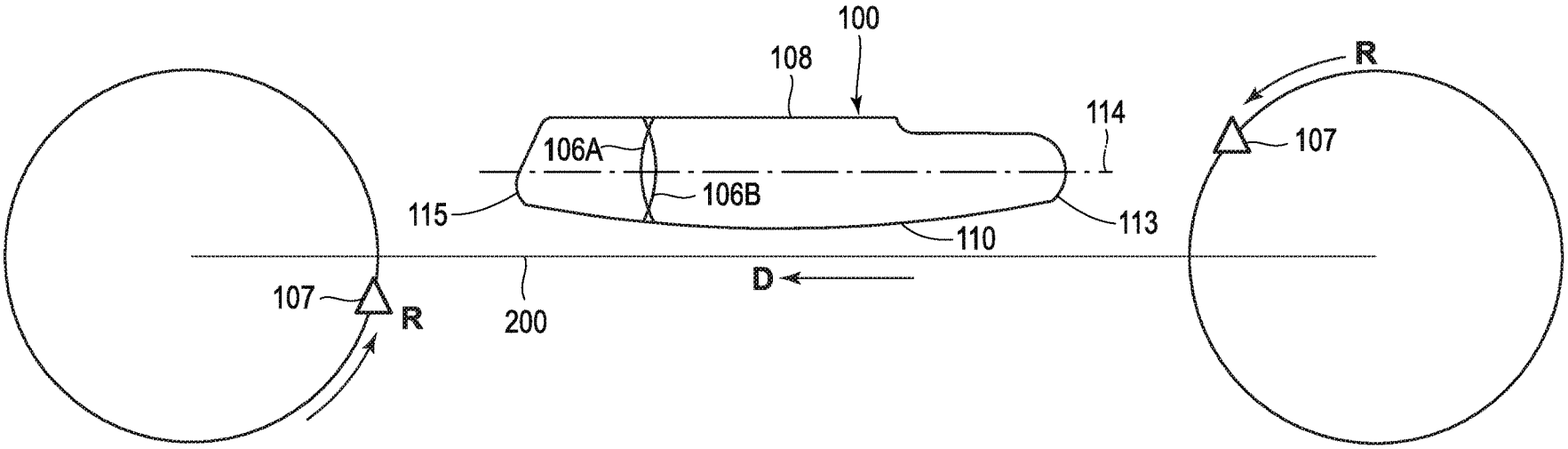
FIG. 4 is a schematic illustration representing one example of both a direction of linear travel and a direction of rotation of a milling tool during a milling operation of an aspect of the disclosure.

An example of a preferred aspect of the disclosure, whereby milled putter face grooves may have a virtual center that is offset from the putter face, is illustrated in FIGS. 3 and 4. FIG. 3 illustrates schematically how a milling tool, when used according to the present disclosure, is positioned relative to the putter face 100, and how the tool travels across the face during the groove milling operation. In this example, a milling tool (not shown) having a feed rate of about 70 inches per minute and rotating at about 882 RPM was passed across the substantially planar face of the club head, in this example, a putter face 100. At this stage, the putter face 100 may have achieved a substantially planar surface, for example, following casting, by removing the gates left behind in the casting process via sawing and/or milling, and using a fly-cut milling operation to render the surface of the putter face more precisely planar prior to the groove milling operation.

In the example of FIGS. 3 and 4, the milling tool resulted in a milling arc having a diameter of 3.0 inches, meaning that the tool bit 107 traveled along a 3.0 inch diameter generally circular path during the milling operation. This path is best illustrated in FIG. 4, it being understood that, because the milling tool rotates, and the tool bit 107 travels in a radial path R while it travels in a linear direction D continuously across the putter face 100 during the milling operation, the tool bit never truly completes a "circle;" thus the discrete circular paths representing each groove milling pass in FIG. 3 are schematic representations only. Because, however, a tool rotating at a high speed, for example, 882 RPM, and moving across the putter face 100 linearly at a feed rate, for example, of 70 inches per minute has a relatively high RPM relative to the feed rate, a circular representation of the tool bit 107 rotational path, and reference to the resulting grooves 106 being arcuate, or portions of a circle is, for all practical purposes, reasonable. In the example of FIGS. 3 and 4, the tool bit used was a 3/64 inch radius triangular milling bit insert, and was set to mill the face to a depth of 0.012 inch. Depending on the milling tool used and the depth of the grooves being milled, it may be possible to achieve the milled pattern 102 in a single pass, however, for deeper grooves, for example those over about 0.012 inch, two or more passes may be required.

As further illustrated in the example of FIGS. 3 and 4, the path along which the milling tool center passes, generally 200, may be positioned away from the centerline, generally 114, of the putter face 100. In this example, as best seen in FIG. 3, the uppermost point of the milling tool arc, having a diameter of 3.0 inches, was positioned about 9.75 mm above the top line 108 of the putter face 100; stated alternatively, the milling tool center, represented by the center line 200, was placed 5.5 mm below the sole 110, or 16.925 mm below the centerline 114 of the putter face 100.

In a preferred aspect, the milling tool center path 200 and cutting bit lies substantially in an imaginary plane that lies on the putter face 100, and the milling tool center path 200 lies below the sole 110 of the putter face 100, although other paths are of course possible. For example, rather than directing the milling tool center path below the sole 110 of the putter face 100, an inverse of the milled pattern 102 on the putter face illustrated schematically in FIG. 3 (for example, a milled pattern 103 substantially as represented by that portion of the tool path below the milling tool center path 200) could be achieved by positioning the milling tool such that its center follows a path above the top line 108 of the putter face, keeping all other variables such as feed rate, rpm, and cutting depth the same.

As another example, the milling tool might run across an imaginary plane that does not lie on the putter face 100, for example, an imaginary plane that is angled slightly toward or away from the plane of the putter face, which orientation would tend to create depth variations of the grooves being milled into the putter face. As still another example, while a milling tool that rotates in a generally circular path has been described, it is within the scope of the present disclosure to provide a milling tool that travels in a non-circular path, for example, along an elliptical or oval path, or cuts straight grooves, cross-hatched grooves, angled grooves, a tool that cuts a deeply-drilled series of holes in the face, etc.

FIG. 4 illustrates a schematic representation of how a milling bit, 107, associated with a milling tool (not shown)

may travel across the putter face 100, in order to produce the milled pattern described herein. As illustrated in FIG. 4, the milled pattern 102 may comprise a plurality of first arcuate grooves 106*a*, (only one arcuate groove 106*a* shown in FIG. 4 for clarity) formed, in this example, by a downward traversing milling bit 107, as it passes across the putter face 100 from the top line 108 toward the sole 110, and travels across the putter face 100 from right to left in the direction D with a counterclockwise rotation R, resulting in the first arcuate grooves 106*a* having an orientation with the open portion of the arc facing right, toward the heel 113 of the putter face 100.

Using a milling tool thus oriented and directed may also result in a plurality of second arcuate grooves 106*b*, (only one arcuate groove 106*b* shown in FIG. 4 for clarity) formed by the milling bit 107 as it completes its rotation and passes upwardly across the putter face 100 from the sole 110 toward the top line 108, while traveling across the putter face 100 from right to left in the direction D with a counterclockwise rotation R, resulting in the second arcuate groove pattern 106*b* having an orientation with the open portion of the arc facing left, toward the toe 115 of the putter face 100. As illustrated in FIG. 4, the milling bit 107 may travel in a linear direction D, in a path 200 that may be generally parallel to the centerline 114 of the putter face 100.

Figure 17:
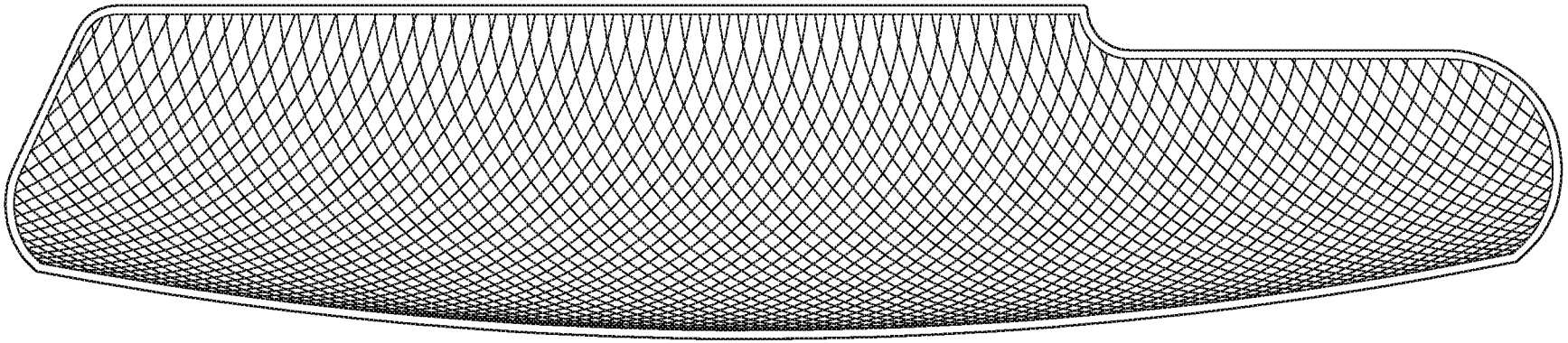
FIG. 17 illustrates another example of a putter head of the disclosure with a milling pattern formed using a method as illustrated in FIG. 18.
Figure 18:
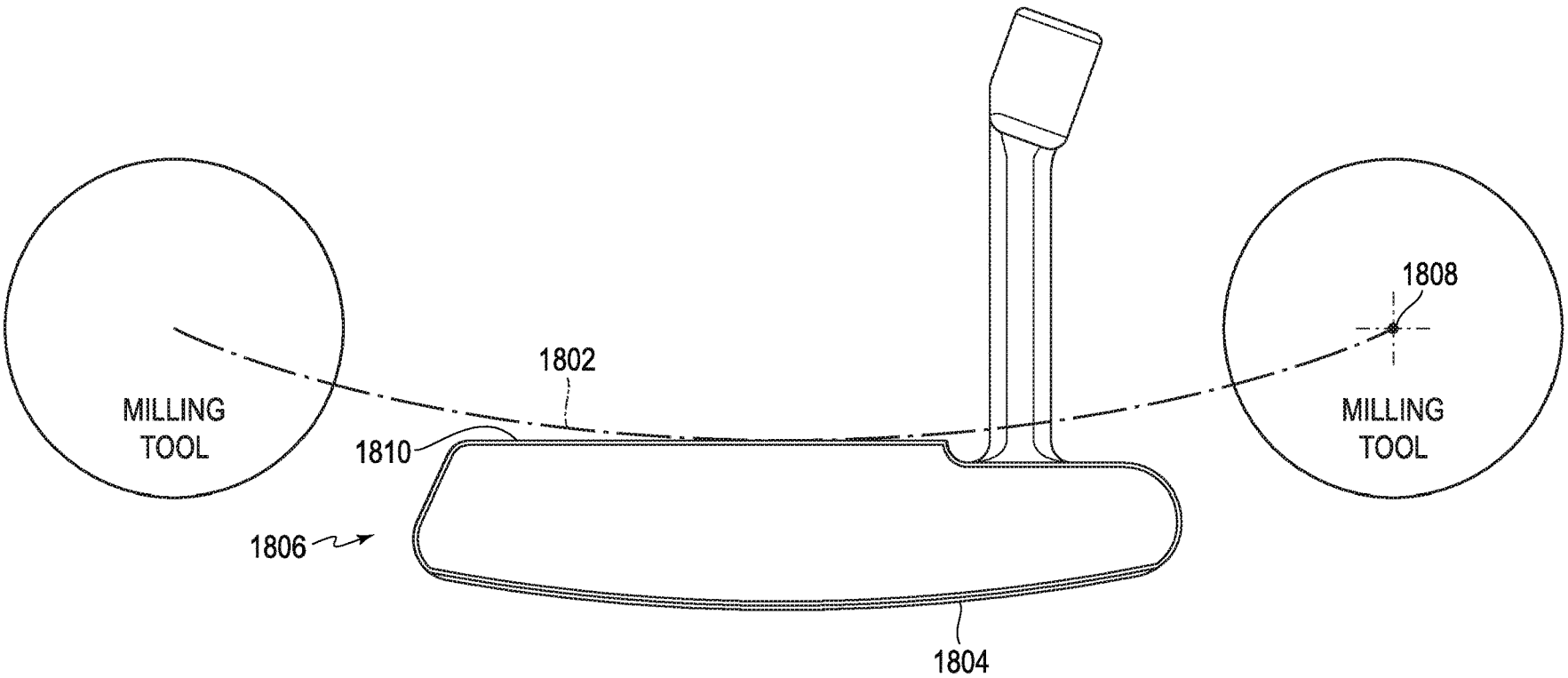
FIG. 18 illustrates a method of forming a milling pattern by passing the milling tool across a putter face along a curved path matching a curve of the putter face, in this example, the curve of the sole.

In another aspect, however, the milling tool may be set up to travel in a curvilinear direction that generally follows the curved contour of the piece being milled, in this case, the sole of the putter head, which can result in visually interesting and appealing groove and ridge patterns. This aspect is illustrated in FIGS. 17 and 18. FIG. 17 illustrates the milling pattern that results using a 3-inch bit diameter at a feed rate of 80 inches per minute and 1400 RPM, resulting in a pitch of 0.04 inch. As illustrated in FIG. 18, the milling tool of this embodiment was set to travel along a curved path 1802 that generally matches the curve or radius of the sole 1804 of the putter head 1806. In this example, the center of the milling tool, 1808, is set to be positioned on or above the top line 1810 of the putter head 1806.

It should be noted that while the above example describes a milling tool passing from right to left across the putter face 100 with a milling bit secured to a chuck rotating in a counterclockwise direction, other setups are possible. For example, the milling tool might be set to travel from heel to toe with a clockwise rotation, from toe to heel with a clockwise rotation, or from toe to heel with a counterclockwise rotation. Other combinations are possible, including directing the tool bit to travel in a non-linear path (for example, zig-zag, sinusoidal, etc.), and/or not along a path 200 parallel to the centerline 114 of the putter face, for example, along a path 200 that angles upwardly from heel to toe or from toe to heal, across the putter face 100, with the centerline of the path of travel remaining below the sole of the putter, etc.

Figure 5:
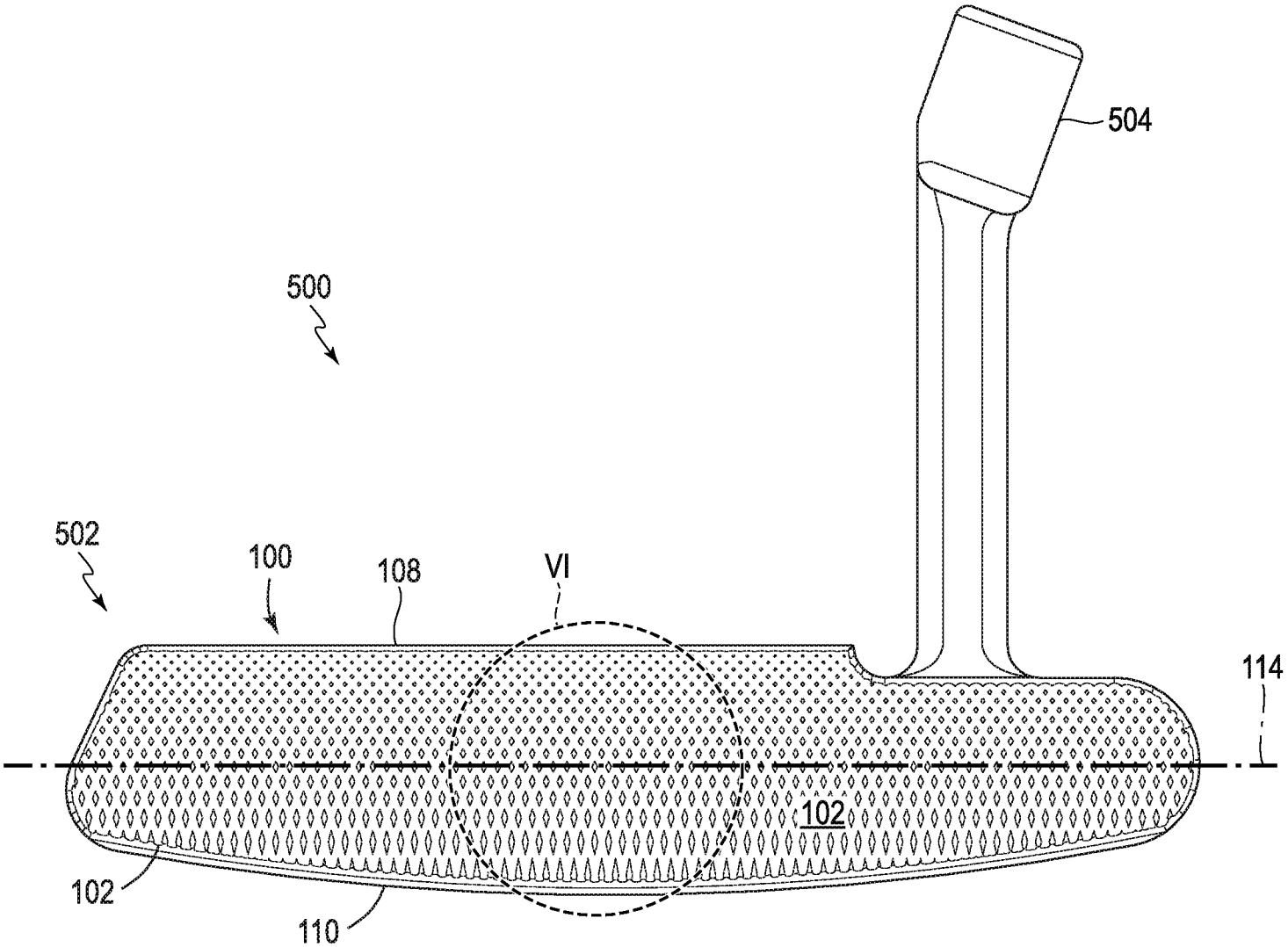
FIG. 5 illustrates a putter head comprising a milled putter face of the disclosure.

FIG. 5 illustrates a portion of a golf club, generally 500, of the present disclosure, comprising a golf club head 502, in this example, a putter head, having a milled putter face 100 comprising a milled pattern 102 substantially as previously described. As also illustrated, the golf club 500 includes a hosel 504 that is connected to the golf club head 502, and to which a golf club shaft having a grip (not shown) is connected. The golf club head 502 may be fabricated of any conventional material. It has been found, however, that 304 stainless steel, when used as the putter head and putter face of the present disclosure, results in a softer "feel" and better "sound" than other materials such as 17-4 stainless.

Figure 6:
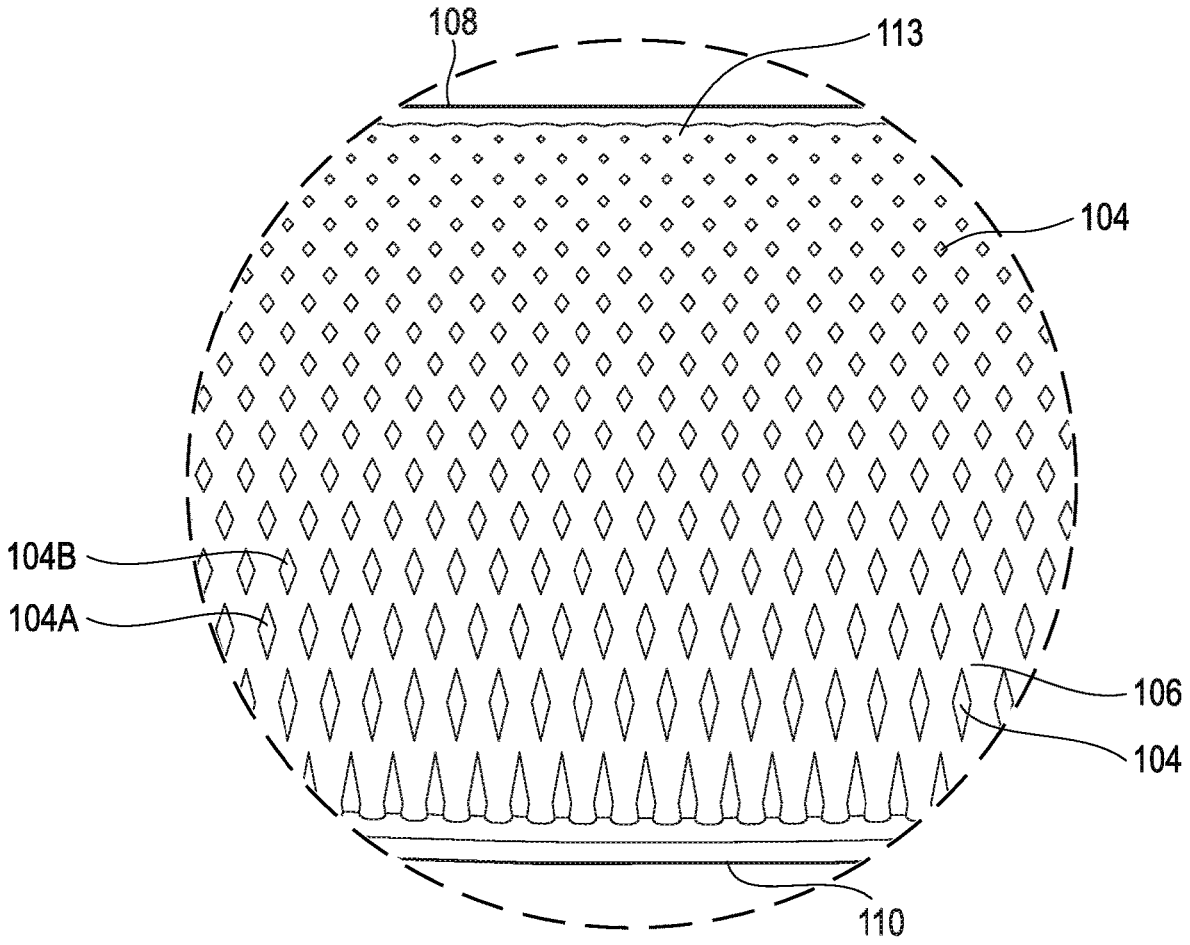
FIG. 6 illustrates an enlarged portion of the milled putter face of FIG. 5.

FIG. 6 is an enlarged detail of circled region VI of FIG. 5. As further illustrated in FIG. 5, and more specifically in FIG. 6, when employing the techniques described herein, the milled pattern 102 of the present disclosure can result in a pattern that varies from the top line 108 to the sole 110 of the putter face 100, for example, by creating a plurality of generally diamond-shaped, e.g., four-sided, ridges 104 across the entire putter face 100, with the area of the ridges decreasing in size as one moves from successive rows of ridges 104 at the sole 110 toward the top line 108 of the putter face 100. This pattern may be beneficially achieved by directing the center of the milling tool along a path of travel below the center line 114 of the putter face 100 and, in a preferred aspect of the disclosure, below the sole 110. In this way, the cutting tool, even when used on a milling tool having a milling diameter of 3.0 inches, is better able to clear the hosel 504, which, in the case of a "plumber's neck" design, may be bent forward of the plane of the putter face 100, providing limited clearance for a tool that rotates too high relative to the putter face 100.

As will be apparent, while a milling tool having a diameter of 3.0 inches may yield a milled pattern 102 that appears, across the entirety of the putter face 100 to comprise a plurality of arcs of a circle, that at smaller lengths of these arcs, such as those defining individual ridges 104, the arcs may appear to be straight lines over such small lengths, as seen in the enlarged detail of FIG. 6.

Figure 7:
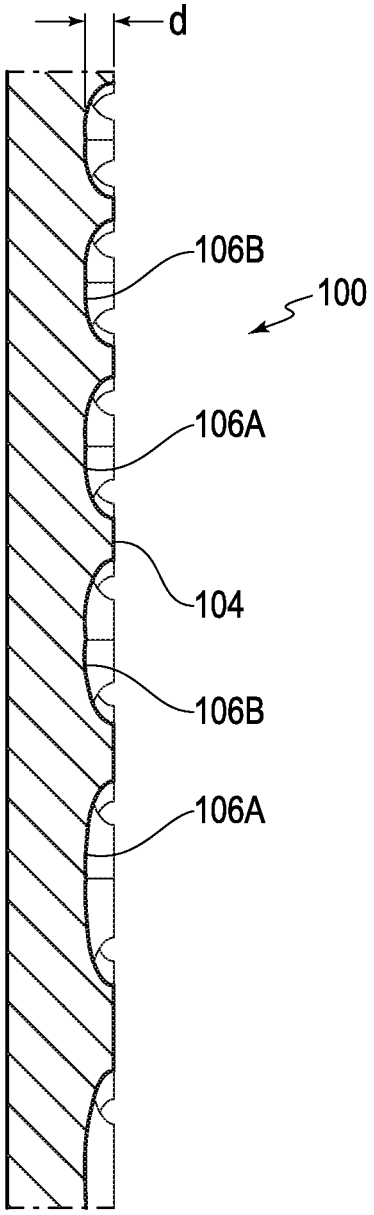
FIG. 7 illustrates a cross-sectional representation of a milled pattern of the disclosure, as taken generally perpendicular to the putter face and perpendicular to the putter face top line of FIG. 2, as viewed along lines VII-VII.
Figure 8:
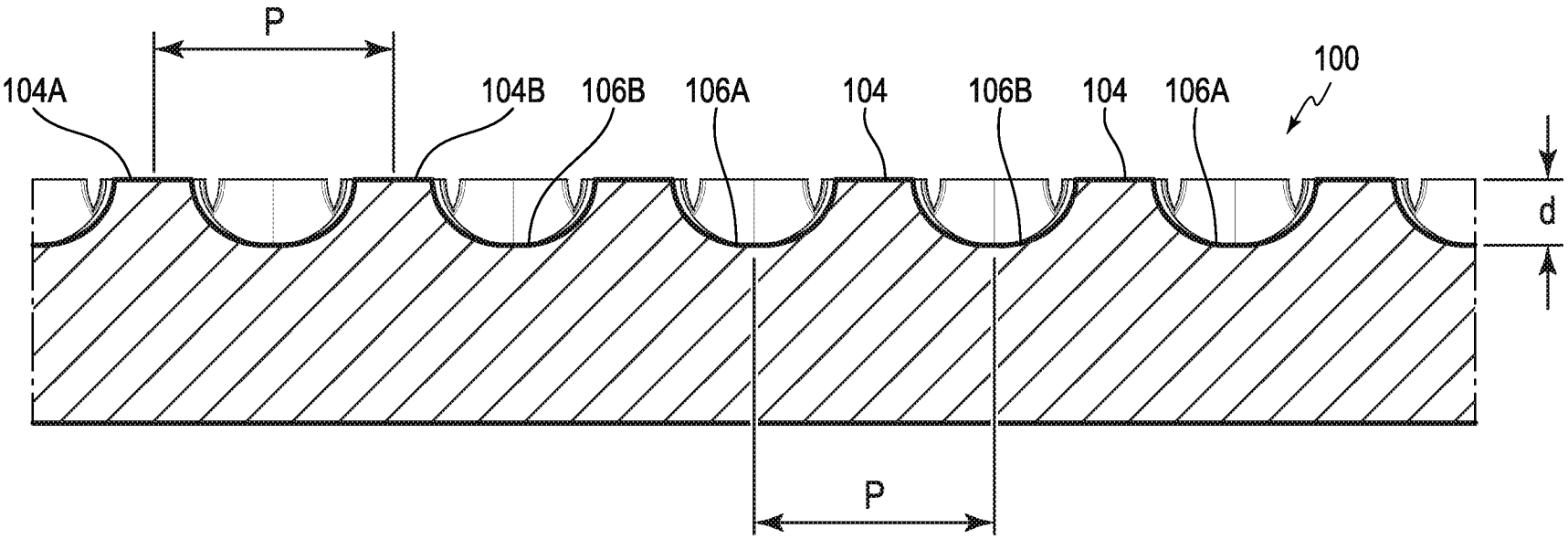
FIG. 8 illustrates a cross-sectional representation of a milled pattern of the disclosure, as taken generally perpendicular to the putter face and generally parallel to the putter face top line of FIG. 2, as viewed along lines VIII-VIII.

Referring now to FIGS. 7 and 8, there are shown schematic, (not to scale), representations of cross sections of the milled pattern 102 of a preferred aspect of the disclosure. FIG. 7 illustrates a cross sectional representation of a milled pattern 102 of the present disclosure, as taken generally perpendicular to the putter face 100 and perpendicular to the putter face top line 108 of FIG. 2, as viewed along lines VII-VII. Stated otherwise, FIG. 7 is a schematic illustration of a cross-sectional plane passing through and generally perpendicular to, the putter face 100 and the top line 108. FIG. 8 illustrates a cross-sectional representation of a milled pattern 102 of the present disclosure, as taken generally perpendicular to the putter face 100 and generally parallel to the putter face top line 108 of FIG. 2, as viewed along lines VIII-VIII. Stated otherwise, FIG. 8 is a schematic illustration of a cross-sectional plane passing through and perpendicular to, the putter face 100, and generally parallel to the top line 108 of the putter face 100 of FIG. 2.

As illustrated in FIGS. 7 and 8, the milled pattern 102 may comprise a series of milled grooves 106*a*, 106*b*, having a depth, d, which in this example is about 0.012 inch, but may vary from about 0.010-0.018 inch. As illustrated, such milled grooves may comprise a first set of grooves 106*a* and a second overlapping set of grooves 106*b* that form ridges 104 therebetween. As previously described, grooves 106*a* and 106*b* may be substantially mirror images of each other, and may be formed by a rotating milling bit.

As illustrated in FIG. 7, along any cross section taken through the club head perpendicular to the striking face and perpendicular to the top portion, the arcuate first grooves 106*a* and arcuate second grooves 106*b* may appear to increase in width from the top portion 108 to the sole portion 110.

As illustrated in FIG. 8, each of the first set of grooves 106*a* may be equally spaced across the putter face 100 relative to each of the adjacent, overlapping second set of grooves 106*b*. Indeed, along any cross section taken perpendicular to the striking face and parallel to the top portion 108, each arcuate first groove 106*a* may be substantially equally spaced from adjacent arcuate first grooves 106*a*, and each arcuate second groove 106*b* may be substantially equally spaced from adjacent arcuate second grooves 106*b*. This equal spacing, that is, arcuate first grooves 106*a* being equally spaced from adjacent arcuate first grooves 106*a*, and arcuate second grooves 106*b* being equally spaced from adjacent arcuate second grooves 106*b*, and adjacent arcuate first grooves 106*a* and arcuate second grooves 106*b* being equally spaced from one another, may be achieved by maintaining a constant feed rate and constant RPM of the milling tool across the putter face during the milling operation. Note, however, that while this equal spacing may be achieved, as illustrated in FIG. 8, across discrete cross sections of the putter face, this does not mean that the spacing of adjacent grooves 106*a* and 106*b* is constant across the putter face 100 from the sole 110 to the top line 108. As illustrated in FIG. 6, successive rows of ridges 104*a* and 104*b*, for example, become smaller, of lesser area, which is a function, in this example, of the spacing between grooves 106 narrowing from the sole 110 to the top line 108. In another aspect, the rate of linear travel of the milling tool across the putter face may be varied in order to achieve grooves and ridges of varying spacing. Generally speaking, the slower the milling tool travels across the putter face, the tighter the spacing or "pitch," and the faster the milling tool travels across the putter face, the wider the spacing or "pitch."

As further illustrated in FIGS. 7 and 8, each groove of the arcuate first grooves 106*a* and arcuate second grooves 106*b* may comprise opposing side walls that transition inwardly and downwardly from adjacent ridges toward a lowermost portion of the groove. While the opposing side walls are, in the example of FIGS. 7 and 8 illustrated as curved, straight and inclined opposing side walls may also be provided, in which case the lowermost portion of the groove may comprise a corner where the opposing side walls meet.

To a certain extent, "touch," "feel," and "sound" of a golf club is a subjective metric, dependant on a number of variables including a golfer's preference, experience, skill, strength, age, hand size, etc. But it is possible to objectively measure "touch" and "feel" achievable by a golf club through the use of testing robots that can perform repeatable shots at the same club head speed, with very precise and repeatable impact positions on the striking face. Such robots and related testing tools may include sensors that can measure grip pressure, vibration, etc., on the grip, and monitors that can measure ball speed, rotation rate, azimuth, launch angle etc.

It has been found that a reliable indicator of "touch" and "feel" for putters is a comparison of how different putters perform in terms of ball speed and/or "smash factor" for a given club head speed. Stated in general terms, a putter can be said to impart better "touch" and/or "feel" if it results in a lower "smash factor" or slower ball speed after impact relative to other putters impacting a ball at the same club head speed and in the same location of the club face, with all other variables being as similar as possible. As used herein, "smash factor" is defined as ball speed divided by club head speed at the moment immediately after impact.

Table 1 below illustrates comparative test data for a milled putter face of the present disclosure, "Club A," compared with a milled face putter of the prior art, the Cleveland® Classic Collection putter, "Club B," the striking face for which is illustrated schematically in FIG. 1. Both Clubs A and B had similarly-sized and shaped club heads and striking faces. Club A had a striking face exhibiting a milled pattern comparable to that illustrated in FIGS. 2-8, wherein the grooves have a depth of about 0.012 inch, a width of about 0.006 inch, and an imaginary circle containing each arcuate groove comprises a center in an imaginary plane lying on the striking face, wherein the center is not positioned on the club face, and in the example of Table 1 and FIGS. 2-6, is positioned below the sole 110 of the club head. Club B had a striking face with a much shallower groove pattern, with an average depth of about 0.003 inch, wherein the center of the milling tool arc traveled substantially across the centerline of the striking face from toe to heel. Except for the striking faces, Club A and Club B were virtually the same in other material respects, with each having a club length of 35.06 inches, a final club head weight of 340.4 grams, and a loft of 2.75 degrees.

The comparative test for Club A and Club B was performed using a putting robot set up to hit center shots (striking the ball as closely to the geometric center of the club face as possible) at approximately the same club head speed. Ball speeds were measured using a Quintic Ball Roll camera system. Ten shots were taken for each of Club A and Club B using the same ball type, a Srixon® Z Star ball, having a compression of 84-86, and resulting ball speeds were measured on a level artificial turf surface. As illustrated, the golf club of the present disclosure exhibited an average ball speed of 5.47 miles per hour at an average club head speed of 3.51 miles per hour, for an average smash factor of 1.56. The prior art putter, Club B, exhibited an average ball speed of 5.67 miles per hour at an average club head speed of 3.49 miles per hour, for an average smash factor of 1.62. Thus, both the ball speed and the smash factor for Club A were about 4% lower than Club B of the prior art, even though the average robot club head speed of Club A was slightly higher (0.4%) than that of Club B, an unexpected result.

It is believed that these unexpected results may be related to the deeper and wider grooves and/or smaller ridge areas of the putter face of the present disclosure creating a cushion of air between the ball and the putter face, resulting in a cushioning effect at the moment of impact. Other possible explanations include the possibility that the golf ball deforms more deeply into the wider/deeper grooves, dissipating energy and/or lessening the amount of compression, yielding a slower resulting ball speed after impact.

The groove pattern of Club B was created using a mill with a feed rate of 60 inches per minute and at 1400 rpm, resulting in a constant pitch of 0.0429 inch. In contrast, the groove pattern of Club A was created using a mill with a feed rate of 70 inches per minute at 882 rpm resulting in a pitch (distance between successive grooves) of 0.07937 inch (about 2 mm) FIG. 8 illustrates a pitch P, intended to represent the distance between successive grooves, as measured either from the middle of successive ridges 104*a*, 104*b*, or from the lowest point of successive grooves 106*a*, 106*b*.

It should be noted that it would be possible to employ a milled pattern substantially as illustrated in the prior art of FIG. 1, but with groove depths of, for example, 0.0010 inch and above, in an effort to achieve similar results to those of Table 1. Such attempts, however, would tend to be less preferred, as the centerline region of the putter face, proximate the centerline 14, have larger areas where the grooves do not cross, producing larger area ridges 104, which would tend to impart greater surface area to a golf ball at the point of contact, tending to increase both the resulting ball speed and the smash factor. Similarly, it would be possible to use groove depths of the prior art, for example, 0.003 inch, with the milled pattern 102 of FIG. 2. Such combination, however, would likewise be expected to result in a less preferred (higher) ball speed and smash factor, as the shallower grooves would tend leave larger ridge areas, providing more contact of the golf ball with the putter face.

TABLE 1

| Club | Data | Club speed (mph) | Ball Speed (mph) | Smash Factor |
|---|---|---|---|---|
| A | Avg | 3.51 | 5.47 | 1.56 |
| | Sdev | 0.004 | 0.063 | 0.019 |
| B | Avg | 3.49 | 5.67 | 1.62 |
| | Sdev | 0.009 | 0.018 | 0.005 |
| Relative to Club B, Club A is: | | 0.4% Higher | −4% Lower | −4% Lower |

Figure 16:
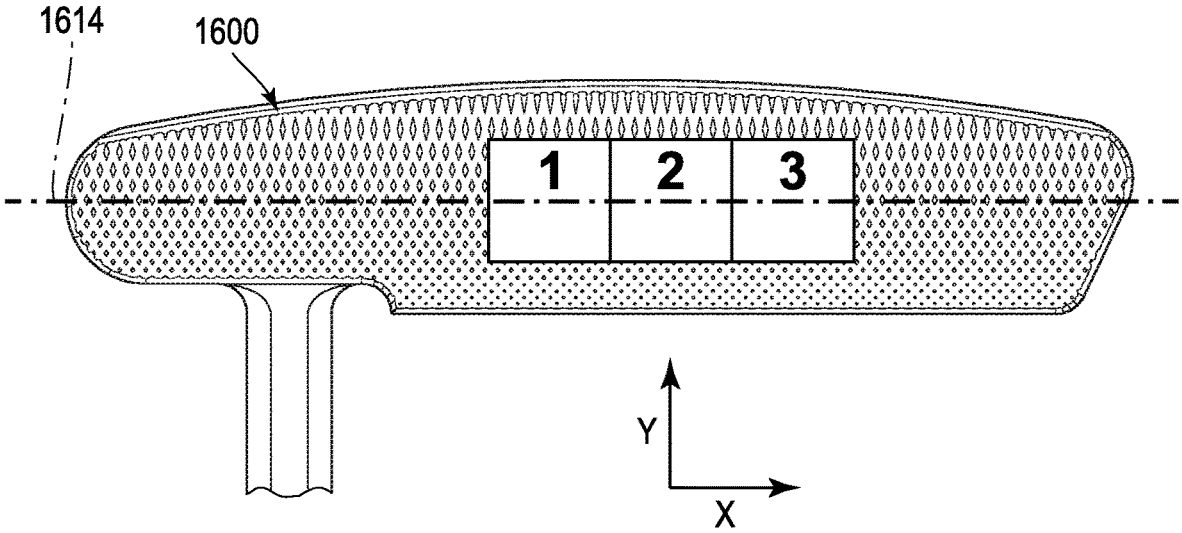
FIG. 16 illustrates locations of metrology measurements taken, as reported in the data of Tables 2 and 3.

Another aspect of the disclosure is illustrated in Table 2. Metrology studies were conducted on a putter face of the present disclosure, substantially as illustrated in FIGS. 2, 5, and 6, identified in Table 2 as Club "A," and compared with similar studies conducted on a putter face of the prior art, the Huntington Beach Classic "1," identified in Table 2 as Club "B." Measurements were taken in three regions of each putter face 1600, illustrated schematically as regions 1, 2, and 3 in FIG. 16. Each of regions 1, 2, and 3 comprise squares with sides of approximately 0.5 inch. Region 2 is centered approximately on the geographic center of the putter face 1600 for both Clubs A and B. Measurements with a stylus profilometer were taken both in an X and Y direction in each of regions 1, 2, and 3. The stylus measurements in the X direction for Club A were generally along the midpoint of regions 1, 2, and 3, thereby generally coinciding with the toe-to-heel centerline 1614 of the putter face 1600 (centerline 114 of FIG. 5).

In one study, bearing area analysis was performed on both Club A and Club B. Bearing area analysis, as indicated by Spk/Sk and Svk/Sk, indicates the peak heights of the putter face relative to the core roughness, and valley depths relative to the core roughness, respectively. Both the Club A and Club B surfaces were highly skewed toward peaked surfaces, with the ratio of Spk/Sk being much greater than Svk/Sk. But as Table 2 illustrates, over all three regions 1, 2, and 3, Club A exhibits much higher Spk/Sk and Spk/Svk ratio values than prior art Club B. In preferred aspects of the disclosure, Spk/Sk is 1.5 or greater, preferably 1.7 or greater, and most preferably 1.9 or greater. As illustrated by the data of Table 2, Spk/Sk values of as high as 2.08 were measured. In another aspect of the disclosure, an Spk/Svk ratio is 200 or greater, preferably 400 or greater, and more preferably 700 or greater. As illustrated by the data of Table 2, Spk/Svk values of as high as 806.6 were measured.

It will be appreciated that while peaks and valleys having a generally diamond-shaped configuration, achieved with arcuate grooves such as illustrated in FIGS. 5-8, resulted in the afore-described Spk/Sk and Spk/Svk ratios, that other configurations of peaks and valleys are contemplated within the scope of the present disclosure, for example, those exhibiting a "waffle" pattern, cone-shaped peaks, etc. Thus, the putter face may comprise a plurality of peaks and valleys of virtually any configuration; for example, the plurality of peaks may have a shape, when viewed in a direction normal to the face, selected from the group consisting of diamond, square, rectangular, oval, round, triangular, pentagonal, hexagonal, octagonal, etc.

TABLE 2

| Club/Region | Spk, μin. | Sk, μin. | Svk, μin. | Spk/Sk | Svk/Sk | Spk/Svk |
|---|---|---|---|---|---|---|
| A/1 | 7864.2 | 3935.1 | 11.0 | 2.00 | 0.00 | 716.4 |
| A/2 | 7883.1 | 3827.9 | 10.0 | 2.06 | 0.00 | 791.0 |
| A/3 | 7890.2 | 3795.7 | 9.8 | 2.08 | 0.00 | 806.6 |
| Average | 7879.1 | 3852.9 | 10.2 | 2.05 | 0.00 | 771.3 |
| B/1 | 1419.1 | 1016.6 | 8.1 | 1.40 | 0.01 | 176.2 |
| B/2 | 1417.4 | 1031.1 | 9.7 | 1.37 | 0.01 | 146.5 |
| B/3 | 1424.1 | 1036.9 | 11.1 | 1.37 | 0.01 | 128.1 |
| Average | 1420.2 | 1028.2 | 9.6 | 1.38 | 0.01 | 150.3 |

Another aspect of the disclosure relative to the prior art was also determined using metrology studies to determine the Normalized Surface Volume, or "NormVolume," of the respective putter faces. NormVolume is a measure of the amount of fluid that would fill the surface from the lowest valley to the highest peak, normalized to the cross sectional area of measurement. The units of NormVolume are "billions of cubic microns per inch-squared" or "BCM." As illustrated in Table 3, the putter face of the present disclosure, Club A, exhibited nearly six times the BCM of the prior art Classic Collection "1" putter face, Club B. The average NormVolume of Club A is about 140 BCM, while that of Club B is about 24 BCM. Such high NormVolumes may contribute to the softer "feel" and/or lower smash factor of the present disclosure by creating a greater volume of air between the club face and the ball, thereby resulting in an air "cushion" effect. BCM values of the putter face of the present disclosure thus preferably are 50 or greater, more preferably 100 or greater, and even more preferably 130 or greater.

TABLE 3

| Club/Region | NormVolume, BCM | SArea Index |
|---|---|---|
| A/1 | 139.3 | 1.0806 |
| A/2 | 140.0 | 1.0813 |
| A/3 | 139.9 | 1.0805 |
| Average | 139.8 | 1.0808 |
| B/1 | 24.6 | 1.0174 |
| B/2 | 24.0 | 1.0170 |
| B/3 | 24.1 | 1.0171 |
| Average | 24.2 | 1.0172 |

It will now be appreciated that, because of the unexpected results achieved by the present disclosure, that other, generally more costly means of providing greater "touch" or "feel" of the prior art, such as providing elastomeric materials on the face or behind the face of the putter head, or providing more expensive softer metals such as copper alloys on the putter face, may be avoided. Indeed, employing the teachings herein, it is now possible for a golf putter to comprise a putter head fabricated, for example, by casting, from a unitary piece of uniform material, thereby avoiding assembly required by securing face inserts, elastomeric materials, etc., to or behind the putter face. Additionally, even greater "touch" or "feel" may be achieved by employing a combination of the milling patterns of the present disclosure along with other features such as softer metal alloys and/or elastomeric inserts, vibration dampening elastomeric, or other shock absorbing layers sandwiched behind the putter face.

Figure 9:
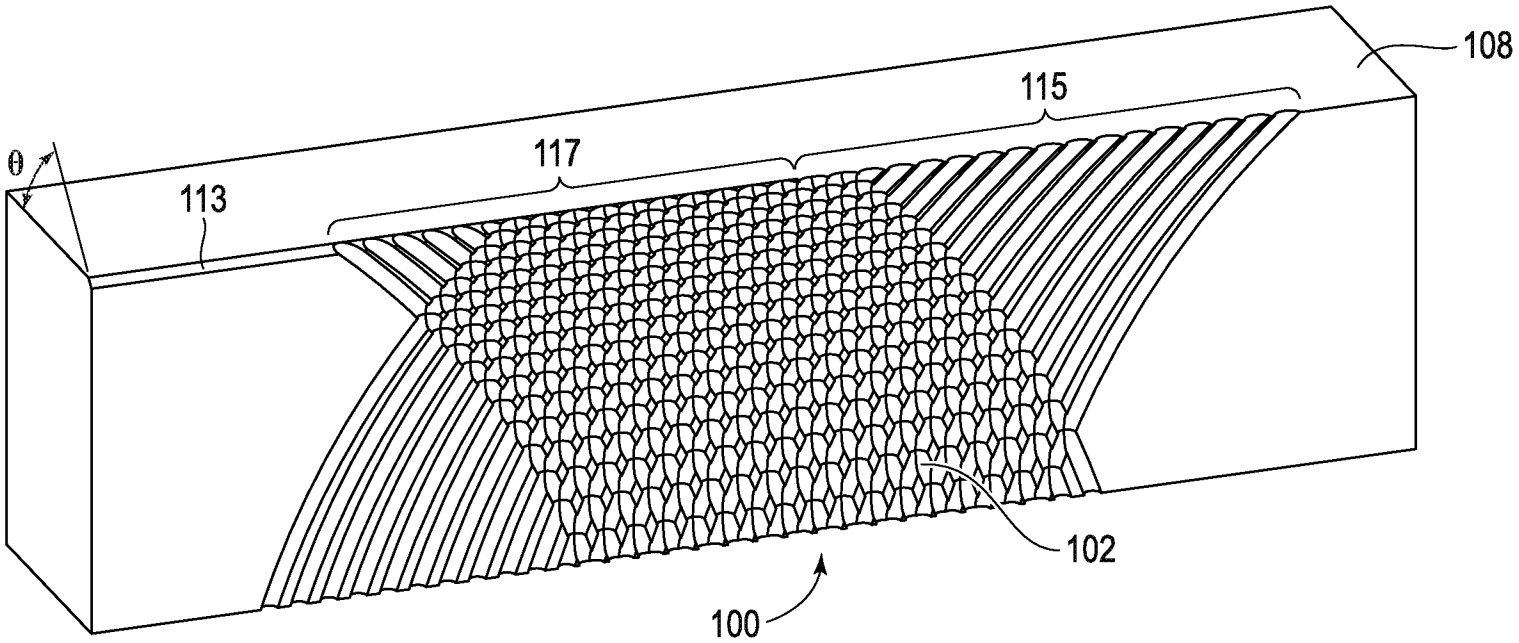
FIG. 9 is an isometric view of a portion of a putter face of the disclosure, illustrating a partial milled pattern of the disclosure and a chamfered portion proximate the top line of the putter face.

Because the milled pattern grooves of the putter face of the present disclosure, as illustrated in FIG. 2, may be significantly wider and/or deeper than those of the prior art, and/or may be positioned as illustrated, this may tend, in some instances, to create a jagged or "saw-toothed" appearance along the top line 108 of the putter face 100, illustrated as region 115, of FIG. 9. For this reason, as also illustrated in FIG. 9, it may be advantageous, particularly if the depth of the grooves exceeds about 0.005 inch, to provide a bevel, or chamfer, 113 on the top line 108, substantially at the intersection of the top line 108 and putter face 100, resulting in a visually straighter and possibly more readily-aligned putter face 100. This chamfer, 113, is preferably formed in the top line 108 at an angle θ of about 10-60 degrees, more preferably at an angle of about 40-50 degrees, and more preferably at an angle of about 45 degrees relative to the putter face 100. Such a chamfer 113 enables a deeply milled pattern 102, for example, 0.010-0.018 inch, while providing the visual appearance of a substantially straight top line 108 edge, illustrated as region 117, substantially reducing or eliminating the "saw-toothed" appearance as illustrated at region 115.

In a preferred aspect, the chamfer 113 is formed to a depth in the top line of the club face approximating the groove depth, plus or minus about 0.005 inch, and for cast putter heads, may be formed using a polishing step. While a straight-walled chamfer is shown in the example of FIG. 9, it will be understood that other efforts to eliminate the "saw-toothed" appearance of deep grooves at the top line, for example, via corner polishing, are contemplated to be within the scope of the present disclosure.

With the exception of the specific parameters described herein, the milled pattern 102 of the present disclosure may be achieved using tools and techniques known to those of ordinary skill in the art. For example, a putter head such as putter head 500 of FIG. 5 may be positioned in a clamping device and oriented such that a milling tool may be passed across the face 100 of the putter head 500. The milling tool may be fitted with a milling tool bit having, for example, the size and dimensions described herein or any other desired size. The milling tool may be set to achieve the desired groove depth and the desired feed rate. Depending on each of these parameters, one pass or two or more passes may be made across the face 100. As previously described, in the case of a milling tool that rotates in a circular arc, the milling tool may be positioned below the center line 114 and even below the sole 110 or above the top line 108 of the putter head 500. As will now be apparent to those of ordinary skill in the art, the milling patterns and metrological characteristics thereof may be adjusted and varied by setting the milling tool depth, speed, tool bit size, pitch, number of passes, etc., in order to achieve the advantages of the present disclosure, for example, improved "touch" and "feel" of the resulting putter.

As previously described with reference to FIG. 11, preferred aspects of the disclosure may have similar groove depths and groove widths both inside and outside of the preferred hitting zone 1101, but this may not always be the case. Indeed, in another preferred aspect of the disclosure, groove depths outside the preferred hitting zone 1101 may be adjusted to differ from groove depths within the hitting zone in order to compensate for off-center hits. For any given putter face, as a general rule, ball speed tends to drop the further away from the geometric center GC the ball is struck. Thus, a ball struck in either a toe-ward region 1115 or a heel-ward region 1113 of the putter face 100 will generally have a slower ball speed than a ball struck in the preferred hitting zone 1101.

Figure 12:
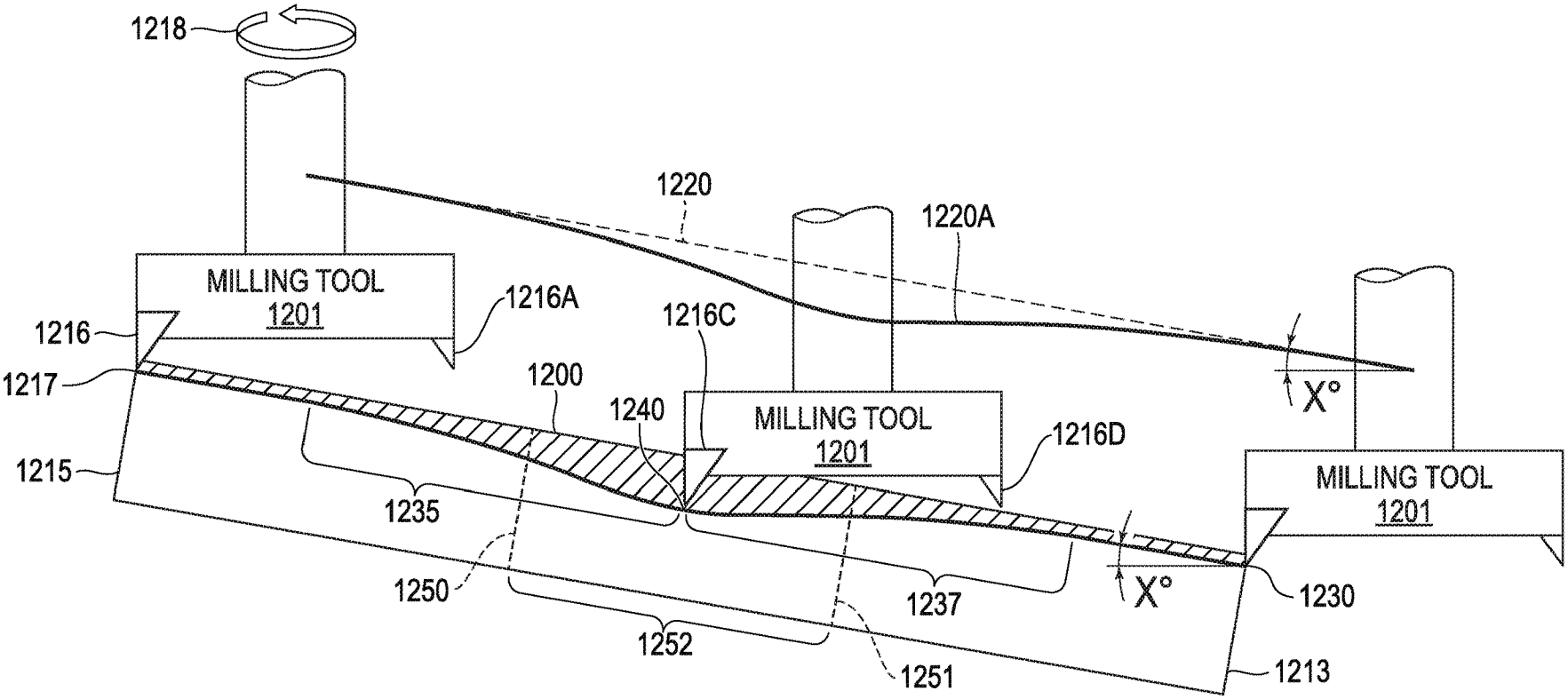
FIG. 12 is a schematic illustration of a milling tool at various locations during a milling operation of a putter face of the disclosure.

It has been determined, however, that by varying the groove depths across the putter face 100 such that the toe-ward region 1115 and heel-ward region 1113 have shallower groove depths than the grooves of the preferred hitting zone 1101, the ball speed may be normalized to provide more consistent ball speeds across the putter face 100. This aspect is illustrated in FIGS. 12-13. FIG. 12 is a schematic representation of a putter face 1200 that exhibits variable milled groove depths across the face in the toe-to-heel direction. In this aspect, a milling tool, generally 1201, may initially be positioned proximate the toe 1215 of the putter face 1200 to begin the milling operation. As illustrated in this example, the putter face 1200 may be inclined at an angle of X° relative to horizontal, which angle may be 0.3-0.7°, and is preferably 0.5°. As illustrated by the dotted line, the milling tool 1201 may be oriented in a generally horizontal position, but set to travel along a travel path 1220 at substantially the same angle X° relative to horizontal, such that the milling tool 1201 travel path 1220 would be generally parallel to the putter face 1200.

When the putter face 1200 is inclined as illustrated in the example of FIG. 12, the milling tool 1201 only cuts the putter face on one pass, in this example, with the cutting insert 1216 hitting the putter face 1200 at point 1217 as the milling tool 1201 rotates, in this example, in a counterclockwise direction represented by arrow 1218. As illustrated, the milling tool may rotate in a generally horizontal orientation relative to the putter face 1200, although other orientations are of course possible, depending on how the milling tool and putter face are set up. Point 1217 may correspond to a shallowest groove depth on the toe-side of the putter face 1200, when variable groove depths are cut, as will subsequently be described. Due to the incline of the putter face 1200 relative to the generally horizontal rotation of the cutting insert 1216, (or the relative orientation of the putter face 1200 being substantially non-parallel to the plane of rotation of the cutting insert 1216) the cutting insert 1216 misses the putter face as it rotationally advances, for example, by 180°, as illustrated by repositioned cutting insert 1216*a*.

Obtaining milled grooves of variable depth may be achieved according to a preferred aspect, as illustrated by the following example, wherein the milling tool 1201 is set to cut initial grooves at a point proximate the putter toe 1215 at a first shallowest groove depth, for example, 0.003 inch, at point 2017. In this example, the milling tool 1201 has a 3.0 inch diameter and is set to initiate the milling sequence at a feed rate of 174 inches per minute and 882 RPM, resulting in a pitch of 5 mm. As illustrated, as the milling tool 1201 travels across the putter face 1200, in this example, downwardly from toe 1215 to heel 1213, it may be directed along a jig (not shown) or other guide or mechanism in order to vary the depth of the grooves being cut along the travel path 1220 as illustrated by travel path 1220*a*, which, as illustrated, deviates from a hypothetical straight path 1220 that is parallel to the putter face 1200. As further illustrated, this travel path 1220*a* may initially start at a shallowest toe-side groove depth at point 1217, for example, at a groove depth of 0.003 inch, and transition more deeply through a first transition region 1235, either gradually or abruptly, to a maximum groove depth 1240, for example, 0.015 inch. Preferably, the maximum groove depth 1240, as well as the deeper portions of the transition region 1235 are formed within the preferred hitting zone 1101 of FIG. 11, represented in FIG. 12 as toe-ward side dotted lines 1250 and heel-ward side dotted lines 1251, defining the width of the preferred hitting zone 1252. Preferably, the maximum groove depth 1240 occurs proximate the geometric center of the putter face 1200.

Figure 13A:
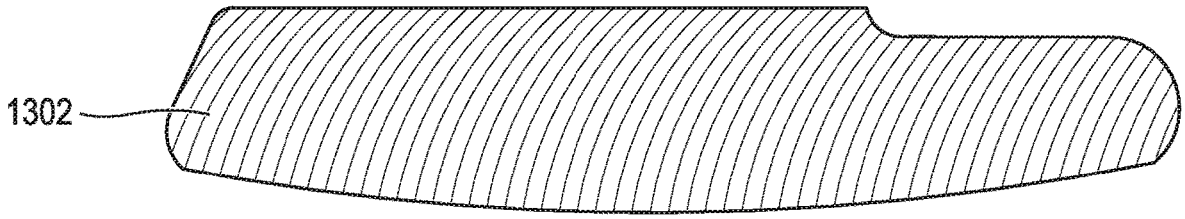
FIGS. 13A-13C illustrate grooved patterns of the disclosure resulting from the milling operation illustrated in FIG. 12.
Figure 13B:
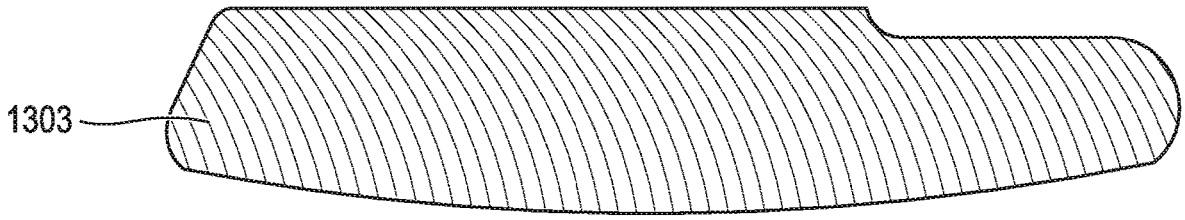
Figure 13C:
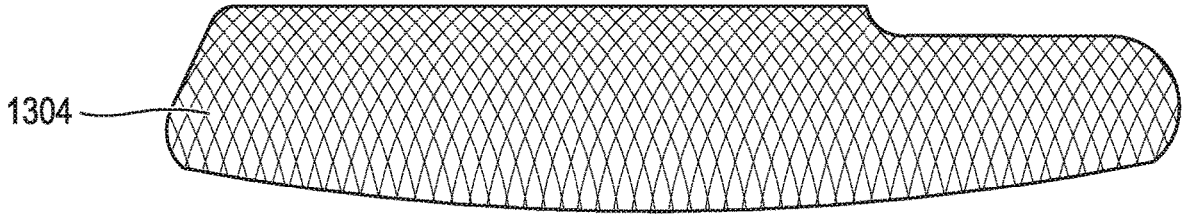
Figure 19:
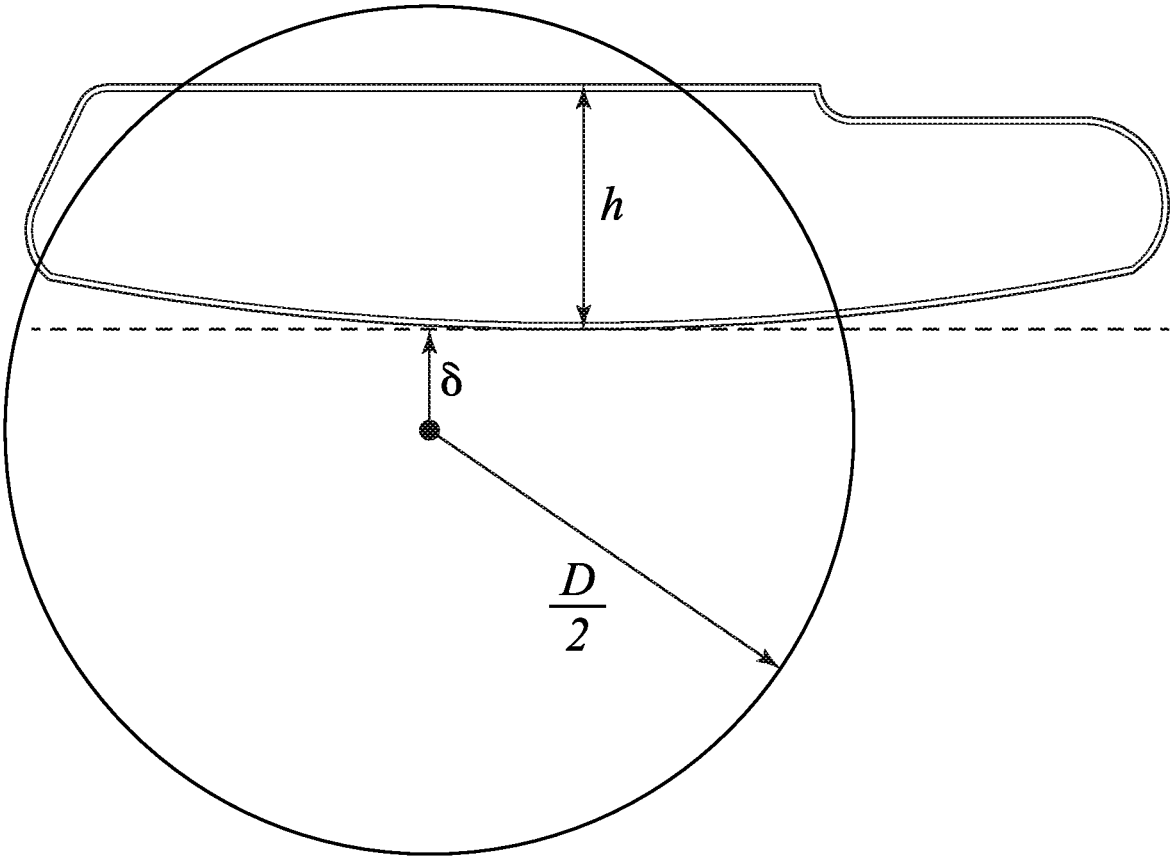
FIG. 19 illustrates the variables required to determine a minimum angle of inclination of the putter face needed for only one side of the milling tool to hit the surface.

A portion of the transition zone 1235 may also fall within the preferred hitting zone 1252. As also illustrated, if the putter face is angled downwardly from the toe 1215 to the heel 1213, as illustrated in FIG. 12, the angle X° may be selected such that even when the milling tool 1201 reaches the deepest point of the travel path 1220*a*, such that the cutting insert 1216*c* is at its deepest point on the cutting side of its rotation, that when the insert reaches the other side of its rotation, illustrated as cutting insert 1216*d*, the insert does not cut into the putter face. The minimum angle X° needed for only one side of the milling tool to hit the surface, resulting in a one-sided pattern such as illustrated in FIGS. 13A-13C as milling patterns 1302 and 1303, may be determined according to the following relationship, the variables of which are shown in FIG. 19:

$$X^{o} = \tan^{-1}\left(\frac{d}{\sqrt[2]{\left(\frac{D}{2}\right)^{2} - (h+\delta)^{2}}}\right)$$

Where d=maximum groove depth, inches

D=diameter of the mill bit rotational travel path, inches

H=the height of the putter face, inches

δ=the offset of the mill bit center to the bottom of the face of the putter, inches Because, in one aspect, the milled grooves are arcuate, being cut by a rotating milling tool as it passes across a jig or other guide to vary the milling depth, a particular groove may exhibit variable groove depths from one end of the groove to the other. As an example, an arcuate groove passing through the geometric center GC of the putter face 1200 may have a depth at that point of 0.015 inch, but the same groove, at a point remote from the geometric center GC, may have a depth of 0.010 inch or 0.003 inch, for example, in that portion of the transition zone 1235 outside of the preferred hitting zone 1252.

The milling tool may maintain the same feed rate and RPM as it transitions across the putter face 1200, resulting in a uniform pattern of grooves as illustrated in FIGS. 13A-13C, wherein the pitch is constant across the pattern. In a preferred aspect, the feed rate, the RPM, or both may be altered, however, as the milling tool passes across the putter face, for example, as the milling tool approaches the preferred hitting zone. For example, it may be desirable to decrease the feed rate, in this example, from 174 inches per minute, to 70 inches per minute as the milling tool 1201 approaches the toe-ward side 1250 of the preferred hitting zone 1252, while maintaining the RPM at 882. This results in the pitch changing from 5 mm to 2 mm in the region of the putter face experiencing that slower feed rate. It may then be desirable to again increase the feed rate, for example, back to 174 inches per minute, as the milling tool leaves the preferred hitting zone and approaches the heel-ward end of the putter face, which again returns the pitch to 2 mm. Other variations of feed rate, RPM, groove depth, pitch, etc., are of course possible and within the scope of this disclosure.

After the cutting insert 1216*c* reaches the maximum depth 1240, the milling tool 1201 may, by following the travel path 1220*a* as illustrated, pass through another transition zone, 1237, that transitions from the maximum depth 1240 to a shallowest heel-side depth 1230, which may be the same or different from the shallowest toe-side depth, but is preferably shallower than the maximum depth 1240. The milling tool may, upon reaching a predetermined depth, for example, proximate the heel-ward side 1251 of the preferred strike zone 1252, increase the feed rate, for example, back to 174 inches per minute.

FIGS. 13A-13C illustrate the steps of a preferred method of creating groove patterns of the present disclosure, either for groove patterns having varying groove depth, as illustrated in FIG. 12, or for groove patterns having a uniform groove depth. As previously described, FIGS. 13A-13C also illustrate groove patterns achieved using a constant feed rate which therefore produces a uniform pitch across the putter face.

In the first step, a putter head is fixed with the putter face angled as described with respect to FIG. 12, so that only one side of the milling bit hits the surface as the bit passes across the face, resulting in a first set of arcuate grooves comprising a first milling pattern 1302, which is shown in FIG. 13A. The milling tool is set to perform the desired milling operation to the desired milling depth across the face. In one aspect, the milling tool comprises a 3 inch mill bit having a center set to about 5.5 mm below the sole of the putter face. This step may be performed in one or more passes.

In the second step, the putter head is rotated 180 degrees and the milling operation of the first step, in one or more passes, is repeated, creating a second set of arcuate grooves comprising a second milling pattern 1303, which is shown in FIG. 13B. As illustrated, first and second milling patterns 1302 and 1303 may be substantial mirror images of each other. The resulting crossing milling pattern, 1304, shown in FIG. 13C, is an overlay of the second milling pattern 1303 relative to the first milling pattern 1302.

As previously described, a 3/64 inch radius triangular cutting insert 1216 may be used. As set forth above in Table 1, at a given club head speed, a putter face having shallower grooves may be expected to result in a higher ball speed and smash factor following impact than a putter face having deeper grooves. This is believed to be the result of cutting deeper grooves creating more space between ridges, and ridges having less surface area for the club face to strike the ball, while shallower grooves result in greater contact area with the struck ball and consequent greater smash factor and ball speed.

Figure 14A:
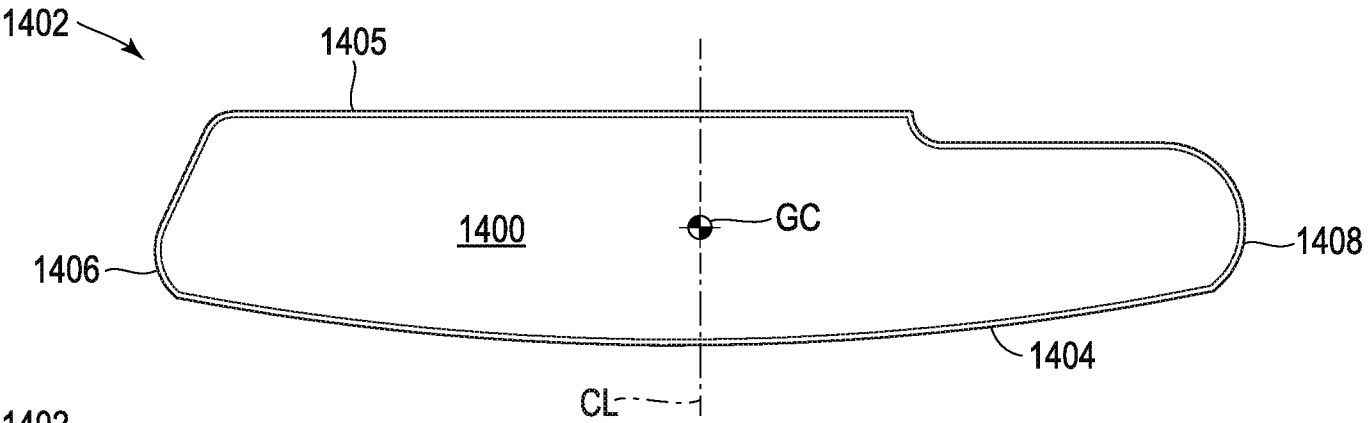
FIGS. 14A-14B illustrate a variable milled groove depth across a putter face with reference to a bottom view of a putter head.
Figure 14B:
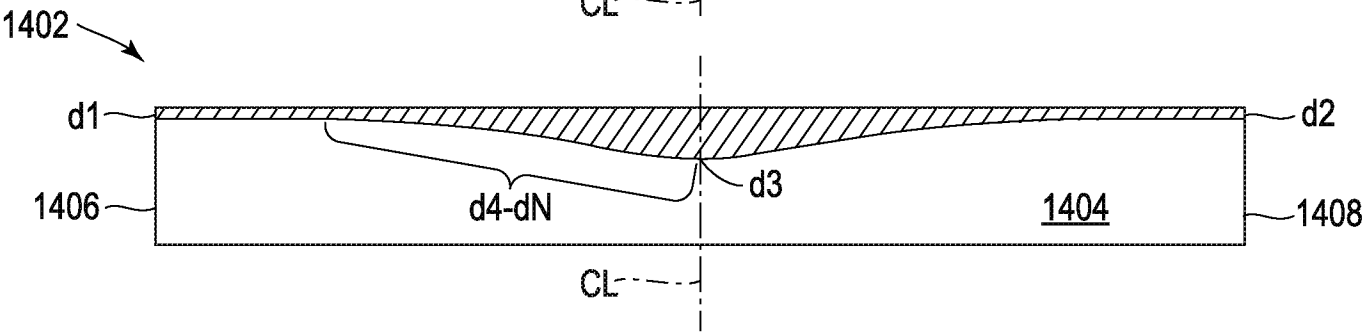

FIGS. 14A and 14B illustrate a relationship between a putter face 1400 and a putter head, generally 1402. The putter face 1400 of FIG. 14A is illustrative only; any shape of putter face may be milled according to the teachings of the disclosure. FIG. 14A illustrates a putter face 1400 as viewed from the front. FIG. 14B illustrates a putter head generally 1402 which may have a putter face 1400 of FIG. 1, as viewed from the sole 1404 of the putter head 1402. As illustrated, a variable milled groove pattern may, as previously described, exhibit a relatively shallow groove depth d1 proximate the toe 1406 of the putter head 1402 and a second relatively shallow groove depth d2 proximate the heel 1408 of the putter head 1402. These groove depths d1 and d2 may be the same or different, and may be 0.000-0.006 inch. In this aspect, a smooth, non-milled portion of a putter face would be regarded as having no grooves, and hence a groove depth of 0.000 inch in that area. As illustrated, whether d1 and d2 are the same or not, they may be shallower than d3, the maximum depth of grooves in the putter face 1400. As illustrated, the maximum groove depth d3 may coincide with a centerline CL of the putter face 1400 and putter head 1402, and may also coincide with a geometric center GC of the putter face 1400. As further illustrated, a transition zone of groove depths d4-dN may exist between either or both of the groove depths d1, d2 and d3.

In another aspect, the putter head and method of milling illustrated in FIGS. 12-14B may, in addition to, or instead of, being tilted from the toe 1215 to the heel 1213, be tilted from the sole 1404 to the top line 1405. In this aspect, the jig (not shown) for the milling tool may provide a cutting path 1220*a* that varies the depth of the grooves in the sole-to-top line direction. For example, the grooves may vary from a shallower depth in a region proximate the sole 1404 to a deeper depth in the preferred strike zone 1252 (FIG. 12) to a shallower depth in a region proximate the top line 1405.

While the preferred embodiments of the present disclosure have been described above, it should be understood that they have been presented by way of example only, and not of limitation. It will be apparent to persons or ordinary skill in the relevant art that various changes in form and detail can be made therein without departing from the spirit and scope of the disclosure as claimed. For example, it is feasible to provide groove patterns that are not milled, or not arcuate, yet still provide the benefits of the present disclosure as claimed. Also, it is within the scope of the present disclosure to create a pattern of straight, wavy, angled, or curved non-circular overlapping grooves, for example by milling or other techniques known in the art, such as grinding, etching, laser milling, etc., in order to achieve the unexpected results of lower ball speed and smash factor as described herein. This may be accomplished, for example, by maintaining the groove depths and widths comparable to those described herein, as well as similar spacing between grooves. Similarly, while preferred embodiments of the disclosure illustrate a milled pattern covering substantially the entire face of the golf club, it will now be recognized that providing milled patterns over only a portion of the face may be done, for example, by milling only that portion of the face proximate the face center, where a golf ball is most commonly struck. While much of the disclosure and figures describe and illustrate putter-type golf club embodiments, it will be understood that the disclosure is intended to apply to other non-putter golf club embodiments, such as wedges, irons, and woods.

As another example, while forming a putter head via casting from metal, such as 316 stainless steel, comprises a preferred aspect of the disclosure, other techniques for forming putter heads exhibiting attributes of the present disclosure are possible and within the scope described. For example, putter heads of the present disclosure may be formed by 3D printing, or may be molded from metal or non-metal materials such as ceramics.

Thus the present disclosure should not be limited by the above-described exemplary embodiments, but should be defined only in accordance with the following claims and their equivalents. Furthermore, while certain advantages of the disclosure have been described herein, it is to be understood that not necessarily all such advantages may be achieved in accordance with any particular embodiment of the disclosure. Thus, for example, those of ordinary skill in the art will recognize that the disclosure may be embodied or carried out in a manner that achieves or optimizes one advantage or group of advantages as taught herein without necessarily achieving other advantages as may be taught or suggested herein.

The terms "a," "an," "the" and similar referents used in the context of describing the embodiments are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely for clarification and does not pose a limitation on the scope of the disclosure. No language in the specification should be construed as indicating any non-claimed element essential to the practice of any embodiments discussed herein.

While different features or aspects of an embodiment may be described with respect to one or more features, it is to be understood that a singular feature so described may comprise multiple elements, and that multiple features so described may be combined into one element without departing from the spirit of the disclosure presented herein. Furthermore, while methods may be disclosed as comprising one or more operations, it is to be understood that a single operation so described may comprise multiple steps, and that multiple operations so described may be combined into one step without departing from the spirit of the disclosure presented herein.

Groupings of alternative elements or embodiments disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Specific embodiments disclosed herein may be further limited in the claims using "consisting of" or and "consisting essentially of" language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments so claimed are inherently or expressly described and enabled herein.

In closing, certain embodiments are described herein, including the best mode known to the inventors. Of course, variations on these described embodiments will become apparent to those of ordinary skill in the art upon reading the foregoing description. The inventor expects skilled artisans to employ such variations as appropriate, and the inventors intend for the embodiments of the disclosure to be practiced otherwise than specifically described herein. Accordingly, this application includes all modifications and equivalents of the subject matter recited in the claims appended hereto as permitted by applicable law. Moreover, any combination of the above-described elements in all possible variations thereof has been contemplated by the inventors and within the scope of the disclosure unless otherwise indicated herein or otherwise clearly contradicted by context. That is, it is to be understood that the embodiments disclosed herein are illustrative of the principles of the disclosure, and therefore, alternative configurations may be utilized in accordance with the teachings herein. Accordingly, the present disclosure is not limited to that precisely as shown and described.

We claim:

1. A putter-type golf club head comprising:

a heel portion;

a toe portion opposite the heel portion;
a sole;
a topline opposite the sole; and
a striking face that, in a measurement region defining a virtual square with sides of 0.5 inch that is centered about a face center, includes:
a plurality of grooves each having a depth of about 0.010-0.018 inch and forming therebetween a plurality of projections, each of the projections having four sides extending toward a planar plateau at a peak of the projection, and the planar plateaus of the plurality of projections being co-planar with each other and parallel to a virtual striking face plane, wherein the planar plateaus are smaller in area adjacent the face center than adjacent a bottom of the striking face;
a peak height relative to a core roughness that is greater than a valley depth relative to the core roughness; and
a ratio of the peak height to the valley depth that is greater than 200.

2. The putter-type golf club head of claim 1, wherein a ratio of the peak height of the measurement region to the core roughness of the measurement region is 1.5 or greater.

3. The putter-type golf club head of claim 1, wherein the ratio of the peak height to the valley depth of the measurement region is greater than 400.

4. The putter-type golf club head of claim 1, wherein the ratio of the peak height to the valley depth of the measurement region is greater than 700.

5. The putter-type golf club head of claim 1, wherein the depth of each of the plurality of grooves is about 0.012-0.015 inch.

6. The putter-type golf club head of claim 1, wherein each of the plurality of projections comprises a diamond-shaped projection.

7. The putter-type golf club head of claim 1, wherein the golf club head comprises a main body that is a unitary piece of one material.

8. The putter-type golf club head of claim 1, wherein the plurality of grooves comprises a pitch of about 2 mm.

9. A putter-type golf club head comprising:
a heel portion;
a toe portion opposite the heel portion;
a sole;
a topline opposite the sole; and
a striking face having a face center and comprising:
a plurality of diamond-shaped projections, each of the projections having four sides extending toward a planar plateau at a peak of the projection, and the planar plateaus of the plurality of projections being co-planar with each other and parallel to a virtual striking face plane, wherein the planar plateaus are smaller in area adjacent the face center than adjacent a bottom of the striking face;
a first groove pattern comprising a plurality of first grooves; and
a second groove pattern comprising a plurality of second grooves,
wherein the second groove pattern is substantially a mirror image of the first groove pattern and overlaid onto the first groove pattern, and
wherein each of the plurality of first grooves and second grooves has a depth of 0.010-0.018 inch and the first groove pattern and the second groove pattern each has a pitch of about 2 mm.

10. The putter-type golf club head of claim 9, wherein, in a measurement region comprising a virtual square with sides of 0.5 inch of the striking face, a peak height of the measurement region relative to a core roughness of the measurement region is greater than a valley depth of the measurement region relative to the core roughness.

11. The putter-type golf club head of claim 9, wherein, in a measurement region comprising a virtual square with sides of 0.5 inch of the striking face, a ratio of a peak height of the measurement region to a core roughness of the measurement region is 1.5 or greater.

12. The putter-type golf club head of claim 9, wherein, in a measurement region comprising a virtual square with sides of 0.5 inch of the striking face, a ratio of a peak height of the measurement region to a valley depth of the measurement region is greater than 400.

13. The putter-type golf club head of claim 9, wherein, in a measurement region comprising a virtual square with sides of 0.5 inch of the striking face, a ratio of a peak height of the measurement region to a valley depth of the measurement region is greater than 700.

14. The putter-type golf club head of claim 9, wherein each of the plurality of first and second grooves has a depth of about 0.012-0.015 inch.

15. The putter-type golf club head of claim 9, wherein the golf club head comprises a main body that is a unitary piece of one material.

16. A putter-type golf club head comprising:
a heel portion;
a toe portion opposite the heel portion;
a sole;
a topline opposite the sole; and
a striking face having a face center and that, in a measurement region comprising a virtual square with sides of 0.5 inch, comprises:
a first groove pattern comprising a plurality of first grooves;
a second groove pattern comprising a plurality of second grooves, the second groove pattern being substantially a mirror image of the first groove pattern;
a plurality of projections formed at intersecting regions of the first grooves and second grooves, each of the projections having four sides extending toward a planar plateau at a peak of the projection, and the planar plateaus of the plurality of projections being co-planar with each other and parallel to a virtual striking face plane, wherein the planar plateaus are smaller in area adjacent the face center than adjacent a bottom of the striking face; and
a ratio of a peak height to a valley depth that is greater than 700.

17. The putter-type golf club head of claim 16, wherein each of the plurality of first and second grooves has a depth of about 0.010-0.018 inch.

18. The putter-type golf club head of claim 16, wherein each of the plurality of first and second grooves has a depth of about 0.012-0.015 inch.

19. The putter-type golf club head of claim 16, wherein the golf club head comprises a main body that is a unitary piece of one material.

20. The putter-type golf club head of claim 16, wherein the plurality of first grooves comprises a pitch of about 2 mm and the plurality of second grooves comprises a pitch of about 2 mm.

* * * * *